US006474789B1

(12) United States Patent
Ishinaga et al.

(10) Patent No.: US 6,474,789 B1
(45) **Date of Patent: *Nov. 5, 2002**

(54) RECORDING APPARATUS, RECORDING HEAD AND SUBSTRATE THEREFOR

(75) Inventors: Hiroyuki Ishinaga, Tokyo; Masahiko Ogawa, Hino; Masami Ikeda; Asao Saito, both of Yokohama; Hideo Saikawa, Kawasaki; Akihiro Yamanaka; Kimiyuki Hayasaki, both of Yokohama; Teruo Ozaki, Kawasaki; Shuichi Murakami, Tokyo; Hiroto Matsuda, Ebina, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/899,185

(22) Filed: Jul. 6, 2001

Related U.S. Application Data

(62) Division of application No. 08/362,749, filed on Dec. 22, 1994, now Pat. No. 6,290,334, which is a continuation of application No. 07/922,870, filed on Jul. 31, 1992, now abandoned.

(30) Foreign Application Priority Data

Aug. 2, 1991 (JP) ..... 3-194118
Aug. 2, 1991 (JP) ..... 3-194136
Aug. 2, 1991 (JP) ..... 3-194137

(51) Int. Cl.[7] ..... B41J 2/05
(52) U.S. Cl. ..... 347/59; 347/57; 347/58
(58) Field of Search ..... 347/54, 59, 57, 347/58

(56) References Cited

U.S. PATENT DOCUMENTS

| | | | | |
|---|---|---|---|---|
| 3,813,513 A | | 5/1974 | Vora et al. | 219/216 |
| 4,380,771 A | | 4/1983 | Takatori | 347/43 |
| 4,429,321 A | | 1/1984 | Matsumoto | 347/59 |
| 4,458,256 A | | 7/1984 | Shirato | 347/58 |
| 4,689,694 A | | 8/1987 | Yoshida | 347/13 X |
| 4,712,172 A | | 12/1987 | Kiyohara | 347/87 X |
| 4,780,730 A | | 10/1988 | Dodge | |
| 5,030,971 A | | 7/1991 | Drake | 347/13 |
| 5,055,859 A | | 10/1991 | Wakabayashi | 347/59 X |
| 5,172,134 A | | 12/1992 | Kishida | 347/13 |
| 5,173,717 A | | 12/1992 | Kishida | 347/13 |
| 5,175,565 A | | 12/1992 | Ishinaga | 347/59 X |
| 5,182,577 A | | 1/1993 | Ishinaga | 347/58 |
| 5,322,811 A | | 6/1994 | Komuro | 347/59 |
| 5,451,988 A | | 9/1995 | Ono | 347/13 |
| 6,290,334 B1 | * | 9/2001 | Ishinaga et al. | 347/59 |

FOREIGN PATENT DOCUMENTS

| | | | |
|---|---|---|---|
| EP | 0278075 | 8/1988 | B41J/3/20 |
| EP | 0307180 | 3/1989 | B41J/3/10 |
| EP | 0444763 | 9/1991 | B41J/2/36 |
| GB | 2059655 | 4/1981 | B41J/5/46 |
| JP | 60-201772 | 10/1985 | B41J/3/20 |
| JP | 63-246261 | 10/1988 | |
| JP | 1-208143 | 8/1989 | |
| JP | 1232072 | 9/1989 | B41J/3/20 |
| JP | 401304951 | 12/1989 | B41J/3/04 |
| JP | 2-178064 | 7/1990 | |

OTHER PUBLICATIONS

Official Letter in Australian Patent Application No. 20769/92.

* cited by examiner

*Primary Examiner*—John Barlow
*Assistant Examiner*—An H. Do
(74) *Attorney, Agent, or Firm*—Fitzpatrick, Cella, Harper & Scinto

(57) ABSTRACT

A substrate having plural recording elements and electrical leads for supplying electric signals to the recording elements includes electrical contacts for external electrical connection for reception of image signals used for driving the recording elements; and a processing circuit for converting signals which are serially supplied to the connecting contact to parallel signals to be applied to the recording elements.

36 Claims, 28 Drawing Sheets

RECORDING APPARATUS, RECORDING HEAD AND SUBSTRATE THEREFOR

CROSS REFERENCE TO RELATED APPLICATIONS

This is a division of application Ser. No. 08/362,749 filed Dec. 22, 1994, U.S. Pat. No. 6,290,334 B1, which is a continuation of application Ser. No. 07/922,870 filed Jul. 31, 1992, now abandoned.

BACKGROUND OF THE INVENTION

Field of the Invention and Related Art

The present invention relates to a recording apparatus, a recording head usable therewith, and a substrate for a recording head. The recording apparatus is used as an output machine for a copying machine, a facsimile machine, a word processor, a host computer or the like. More particularly, it relates to the same in which a plurality of recording elements are used, which are selectively driven by integrated circuit for the driving.

Various types of recording machines are known. Among them, a liquid ejection recording apparatus in which ink is ejected through ejection outlets provided for the respective recording elements, are desired because of the advantages of the low noise non-impact recording operation, capability of high density recording, capability of high speed recording. The recent demands for such apparatus includes the compactness and low cost.

Among the liquid jet recording apparatus, a type using electromechanical converters (piezoelectric elements, for example), a type using electrothermal transducers and a type using pairs of electrodes supplied with a voltage to eject liquid droplets, are known. Further among them, an ink jet recording apparatus of a type in which the recording liquid is ejected using thermal energy, has been commercialized because of its advantages that the liquid ejection outlets (orifices) can be arranged at high density with the result of capability of high resolution recording and that the multi-nozzle (orifice) arrangement is relatively easy with the result of capability of the high speed printing.

In a known recording head used with the recording apparatus of this type, a plurality of recording elements are arranged in a line, and the recording elements are divided into plural blocks each having several tens recording elements, and several or several tens driving circuits for the respective blocks, are formed on one substrate as integrated circuits. The recording elements are selectively driven in accordance with image data by the driving circuits, so that the recording is effected on the recording material such as paper.

These recording heads are particularly noted because of its high resolution and high speed recording. However, further reduction of the cost and the size and the improvement of the performance, color printing function, or the like are desired. Referring to FIG. 29, there is shown a conventional substrate (heater board) having recording elements thereon and a schematic sectional view of the ink jet recording head using the substrate.

In FIG. 29, (d), reference numeral 1 designates a heater board having thermal energy generating means in the form of an electrothermal transducers 2 a top plate 17 is provided with grooves constituting a part of passages for ink 3. The ink 3 is supplied through the passages formed by the heater board 1 and the top plate 17, as indicated by an arrow A. The ink is then heated by the electrothermal transducers 2 on the heater board 1 so that the ink is ejected through the ejection outlets 5 in the direction indicated by an arrow B. In FIGS. 29, (a)–(c), show arrangements of various elements in the heater board 1. It includes electrical leads for electrically connecting various elements, diode arrays 7, and pads 8 for external electrical connection. In the arrangement of FIG. 29, (a), the electrothermal transducers 2, the electrical leads 6, the diode arrays 7 and the pads 8, are disposed in the order named from the ejection outlet 5 side.

In FIG. 29, (b), the electrical connection between various elements are the same as in FIG. 29, (a), but the electrical leads 6 portion and the diode array 7 portions are mixed. In FIG. 29, (c), the electrothermal transducers and the pads 8 are arranged with one-to-one relation therebetween.

In an arrangement of FIGS. 30, (a), (b) and (c), an ink supply port 9 is formed in the heater board 1 having the electrothermal transducer, as contrasted to the case of FIG. 29. In this case, the ink is supplied from the backside of the substrate cover as indicated by an arrow A, and the ink is ejected in a direction substantially perpendicular to the surface of the substrate 1, as indicated by an arrow B.

As for the wiring in the heater board shown in FIG. 29 or 30, two types are known. In one of them, as shown in FIG. 29, (c), and FIGS. 30, (a)–(c), and FIG. 31 designating the equivalent circuit, the electric signals are supplied from the pads 8 to the electrothermal transducers in one-to-one relation (direct drive type). In the other type, as shown in FIGS. 29, (a) and (b) and FIG. 32 showing an equivalent circuit, a matrix arrangement using diodes are used, in which the electrothermal transducers are selectively driven by selective drive voltage application between segment pads SEG and common pads (matrix drive type).

In the direct type shown in FIG. 31, n pads 8 are required for n ejection heaters (electrothermal transducers) 2. In addition, VH pad is required, and therefore, (n+1) pads are required in total. Since the pads 8 are directly connected to the ejection heaters 2, a large current such as approx. 150 mA. With a pulse width of 7 $\mu$S in a 360 dpi recording head for plain paper according to an example of experiments by the inventors, flows therethrough. In addition, the same current multiplied by n, flows through the VH pad. Thus, all the electrical leads have to be designed for large current. Because of the number and large size of the pads, a large area is required for the wiring with the result of bulky substrate and recording head and high manufacturing cost. From the standpoint of the main assembly of the recording apparatus, the connecting portion and the wiring therein are complicated due to the large number of the pads.

FIG. 32 shows another type of matrix drive system. The number of electrical leads and the pads is decreased as compared with the above-described direct type. However, when n ejection heaters 2 are used, the minimum number of pads is $2\sqrt{n}$ (when $2\sqrt{n}$ is not an integer, the value is rounded, and added by 1) are required at minimum. The electric current flowing through the common electrode (COM) pad is the electric current per one ejection heater multiplied by the number of ejection heaters connected with the matrix, as the case may be, and therefore, the electrical leads 12 have to be designed for the large current.

Generally, in an ink jet recording head, there is a liability that the pressure wave at the time of bubble formation is transmitted toward upstream (toward a common liquid chamber) in the form of a back wave, with the result of fluid cross-talk among nozzles. Therefore, simultaneous drives of adjacent nozzles may result in instable ejection due to the back wave. In view of this, it is desirable that the simultaneous drives are effected for nozzles which are spaced greatly, from the standpoint of stabilized ejection and high image quality. However, in the case of the above-described matrix drive circuit, if the common electrode simultaneously drives a large number of different driving elements (COM), large current flows through the thin segment (SEG) leads with the result of potential difference within the leads. If this occurs, the electrothermal transducers are not supplied with proper electric energy. For this reason, there is a problem that the large number of elements are not driven.

The problem of the large number of pads and the complicated wiring in the heater board, is more significant in the case of color recording.

In order to accomplish the color recording, the recording apparatus is provided with a plurality of recording head for the respective colors.

FIG. 33 is a block diagram of a circuit structure for a conventional liquid jet recording apparatus for color recording. Designated by references 2C, 2Y and 2M are recording elements (electrothermal transducers) for cyan, yellow and magenta recording. Several tens of such elements are used. Function elements 10 are for controlling power supply to the recording elements. A shift register circuit 11 aligns the image data, corresponding to the recording elements. It is directly connected with a latching circuit 12 storing data for the recording elements. By using an output of an AND gate receiving as inputs an output of the latching circuit and an output of another AND gate connected at the input to the signal lines 14 and 15 for controlling the power supply period to the recording elements, the recording element can be supplied with the power during the output period of the first mentioned AND gate. In the Figure, the zone indicated by the broken line is formed on the substrate, and therefore, the electrothermal transducers 2, function element array (transistor array 10 in this embodiment) for selectively driving the electrothermal transducers 2, are formed on the substrate.

With this structure, however, the number of contacts between the recording head carriage (main assembly) and the electrical leads is still large with the result of complicated driving circuit. Therefore, the design and productions are still difficult.

U.S. Pat. No. 5,030,971 discloses that in order to reduce the size of the color recording apparatus, the substrates for the different color are made integral. In the U.S. Patent, the elements for the four colors are formed on the same substrate. The driving circuit in this patent is in the diode matrix type, and therefore, the number of electrical leads is small as compared with the case of the direct driving system, and therefore, the size of the recording head itself can be reduced. This will be satisfactory if the number of electrothermal transducers is small. However, if the number is increased to meet the demand for the high speed recording, for example, the number of electrical leads and the pads increases accordingly, with the result that the above-described problem arises.

As regards the manufacturing of the substrate, the yield decreases with increase of the number of recording elements (electrothermal transducers), since the number of diodes and transistors also increases. Also, the yield in the formation of the ink ejection outlets or the like by connection with the substrate, and therefor, it has been difficult to manufacture the substrate having a large number of recording elements.

In the case of the substrate having the supply port as shown in FIG. 30, the utilization factor of the silicone wafer constituting the substrate can not be increased with the result of high cost.

SUMMARY OF THE INVENTION

Accordingly, it is a principal object of the present invention to provide a substrate, a recording head using the same and a recording apparatus using the same, in which the wiring on the substrate is simplified.

It is another object of the present invention to provide a substrate, a recording head using the same and a recording apparatus using the same in which a number of pads on the substrate is reduced, so that a larger number of recording elements can be formed on the substrate.

It is a further object of the present invention to provide a substrate, a recording head using the same and a recording apparatus using the same, wherein even when a large current is used, the current is not concentrated locally on thin electrical leads.

It is a yet further object of the present invention to provide a substrate, a recording head using the same and the recording apparatus using the same in which a number of electrical connection pads is increased, so that the wiring can be simplified and that the manufacturing is easy, the size is reduced and the cost is reduced.

According to an embodiment of the present invention, there is provided a substrate having plural recording elements and electrical leads for supplying electric signals to the recording elements, comprising: electrical contacts for external electrical connection for reception of image signals used for driving the recording elements; and a processing circuit for converting signals which are serially supplied to the connecting contact to parallel signals to be applied to the recording elements.

According to another embodiment of the present invention, there is provided an ink jet recording head having a substrate with plural recording elements and passages for supplying liquid to a neighborhood of the recording elements, the improvement residing in the substrate, comprising: electrical contacts for external electrical connection for reception of image signals used for driving the recording elements; and a processing circuit for converting signals which are serially supplied to the connecting contact to parallel signals to be applied to the recording elements.

According to a further embodiment of the present invention, there is provided a recording apparatus for effecting recording operation with ink droplets ejected, comprising: a recording head having a structure defined above; and electrical signal contact connected with the recording head to supply the signal thereto.

These and other objects, features and advantages of the present invention will become more apparent upon a consideration of the following description of the preferred embodiments of the present invention taken in conjunction with the accompanying drawings.

DESCRIPTION OF THE PEFERRED EMBODIMENTS

Figure 1:
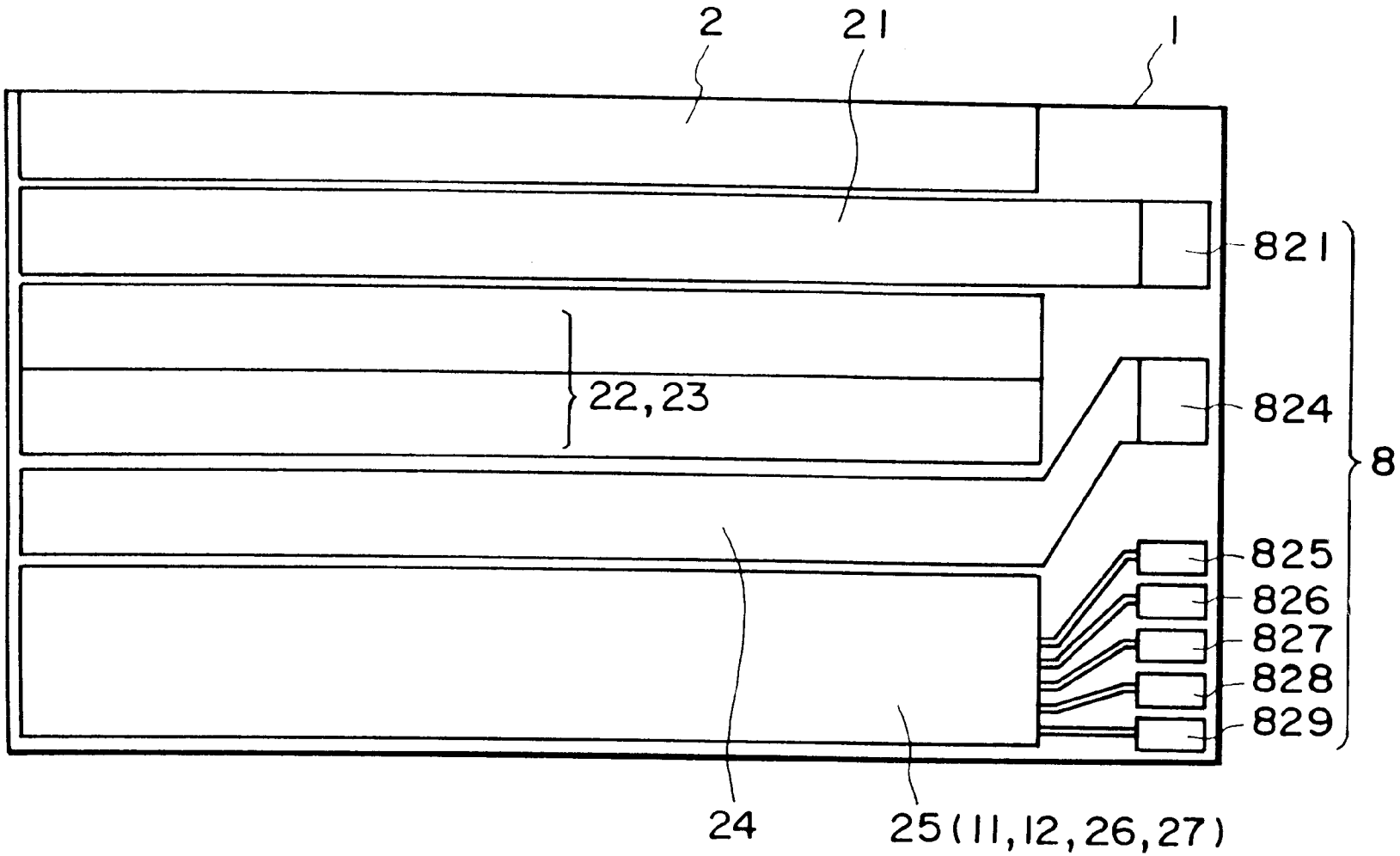
FIG. 1 is a top plan view illustrating an example of layout on a substrate, according to an embodiment of the present invention.

Referring to FIG. 1, there is shown a semiconductor chip 1, according to an embodiment of the present invention. Recording elements are arranged in the longitudinal direction of a substrate 1 in a recording element zone 2. Each of the recording elements are connected to a common electrode 21 at the power supply side, by through hole. Designated by reference numeral 821 is a power supply pad (VH) for the recording elements. Function element arrays 22 and 23 control the power supply to the recording elements, and are arranged so as to permit high density printing. Designated by reference numeral 24 is common grounded electrode (GND) for the recording current for the recording elements. The area thereof is determined depending on the current level supplied to the recording elements. Designated by a reference numeral 824 is a grounding pad. One of the features of the present invention is in a logic circuit zone 25 in which there are provided a logic gate zone 26, a latching circuit 12, shift registers. 11 and 27 are formed on the surface of the semiconductor chip in the form of a driving integrated circuit. The logic circuit 25 functions to control the function element arrays connected to the recording elements (thermal transducer elements).

Figure 2:
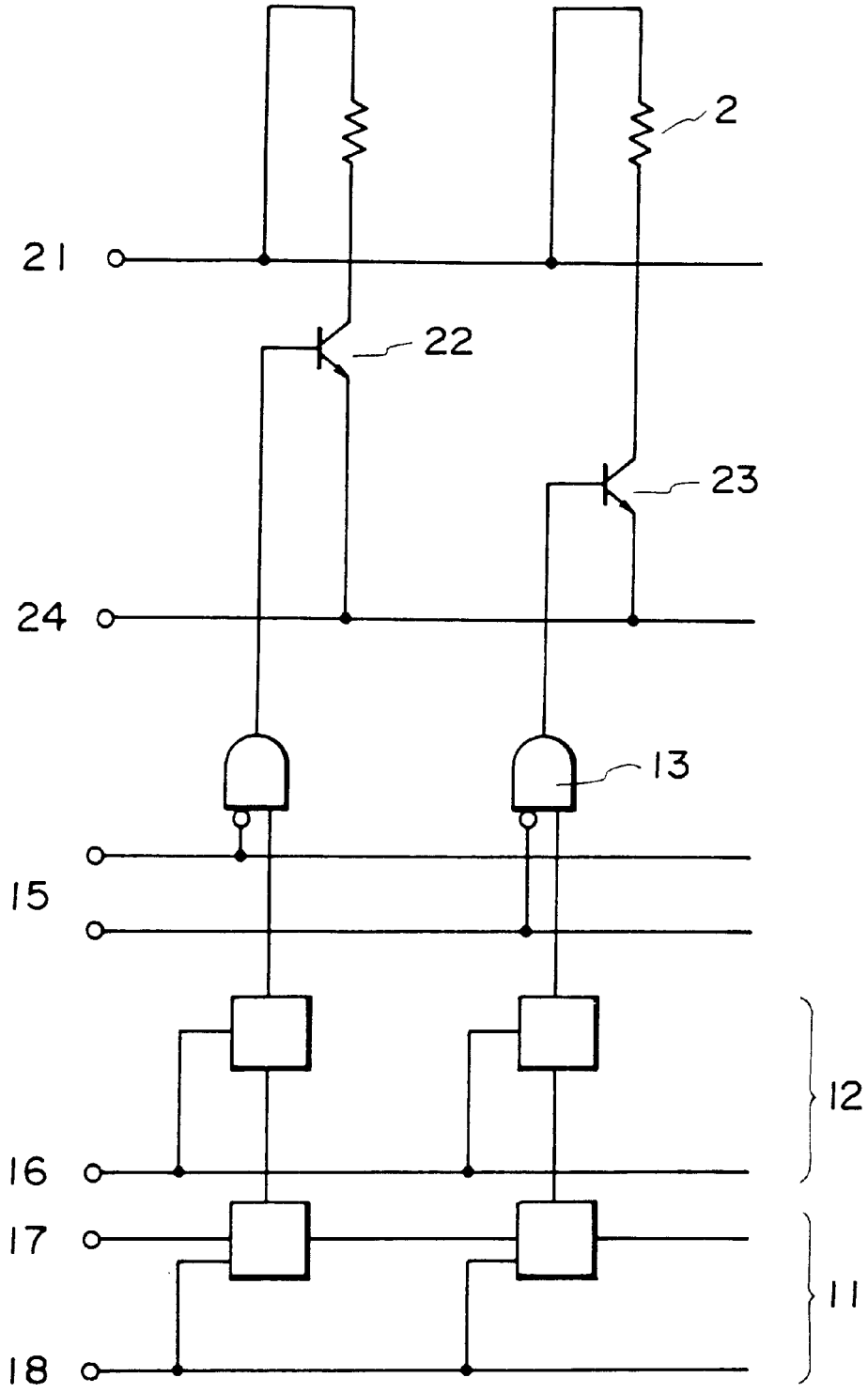
FIG. 2 is a circuit diagram of an equivalent circuit, according to an embodiment of the present invention.

FIG. 2 shows an example of an equivalent circuit of the substrate having the structure as shown in FIG. 1. The recording element 2 is connected with a transistor 23 for selecting the recording element 2. There is shown an enabling leads (15) for actuating the recording element at a given timing, a latch 12 for latching the printing data corresponding to the recording elements, input leads (17) for receiving serial data and a shift register 11 for shifting the serial data with predetermined timing.

Figure 3:
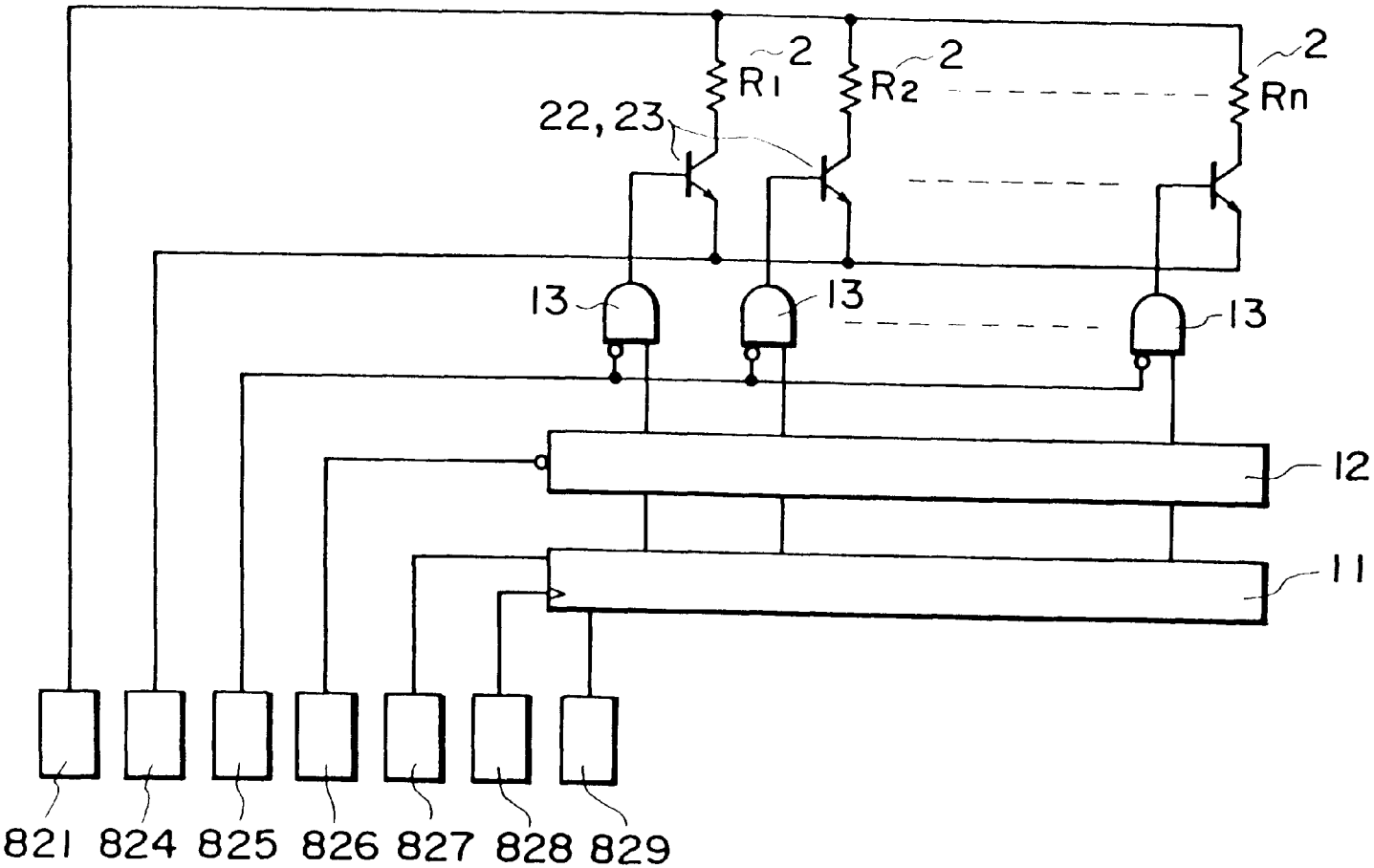
FIG. 3 is a circuit diagram of an equivalent circuit on a substrate, according to the embodiment of the present invention.

FIG. 3 is a further equivalent circuit of the equivalent circuit of FIG. 2. The fundamental circuit structure is the same as that shown in FIG. 2, but in this circuit, the two enabling signal leads are replaced by one lead.

Figure 4:
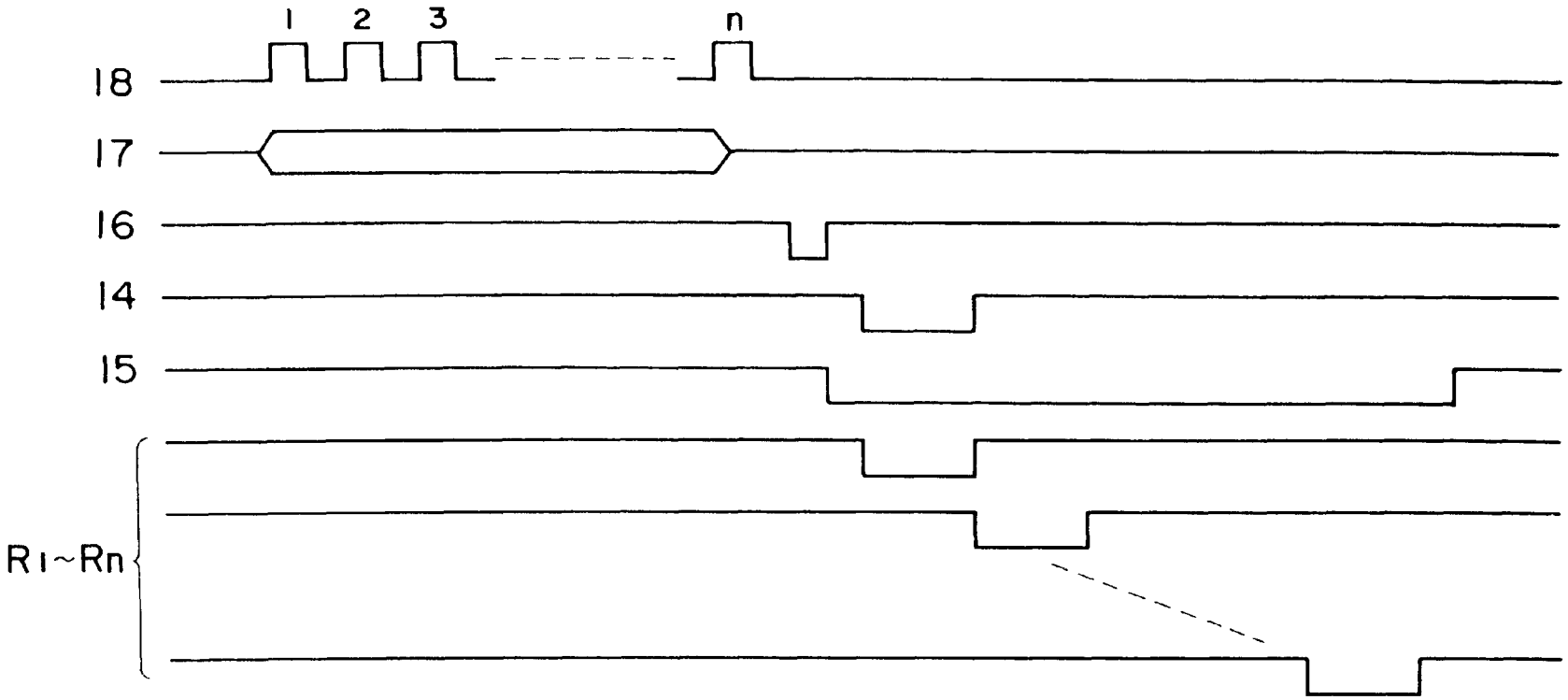
FIG. 4 is a drive timing chart according to an embodiment of the present invention.

FIG. 4 is an operating timing chart of the circuit of FIG. 3. In FIGS. 3 and 4, recording elements are indicated as n heaters R1–Rn, as an example. The circuit comprises a transistors 22, logic gates 13, a latching circuit 12 and a shift register 11. It further comprises pads 821–829 including the VH pad 821. GND pad 824, a strobe pad 825, a latch pad 826, a data pad 827, a clock pad 828 and logic power source VDD pad 829.

Referring to FIG. 4, the operation of the circuit of FIG. 3 will be described.

Clock signals 18 and serial data signals 18 synchronized therewith are supplied to the shift register circuit 11 at the timing shown in FIG. 4. When all of n data are set, a latch signal (negative logic) 16 shown in FIG. 4 is supplied to the latch circuit 12, by which the supplied data are stored. The data are kept stored until the next latching signal is supplied. Then, an AND-output of the strobe signal 14 and the latch output provided by the logic gate 13 is supplied to the transistors 22 and 23, so that the driving signals for the heaters R1–Rn (output signals of the transistors) are produced. In this embodiment, the driving signal wave form is determined by the input wave form of the strobe signal 13 (enabling signal (EI), in the case of FIG. 2 example).

Figure 18:
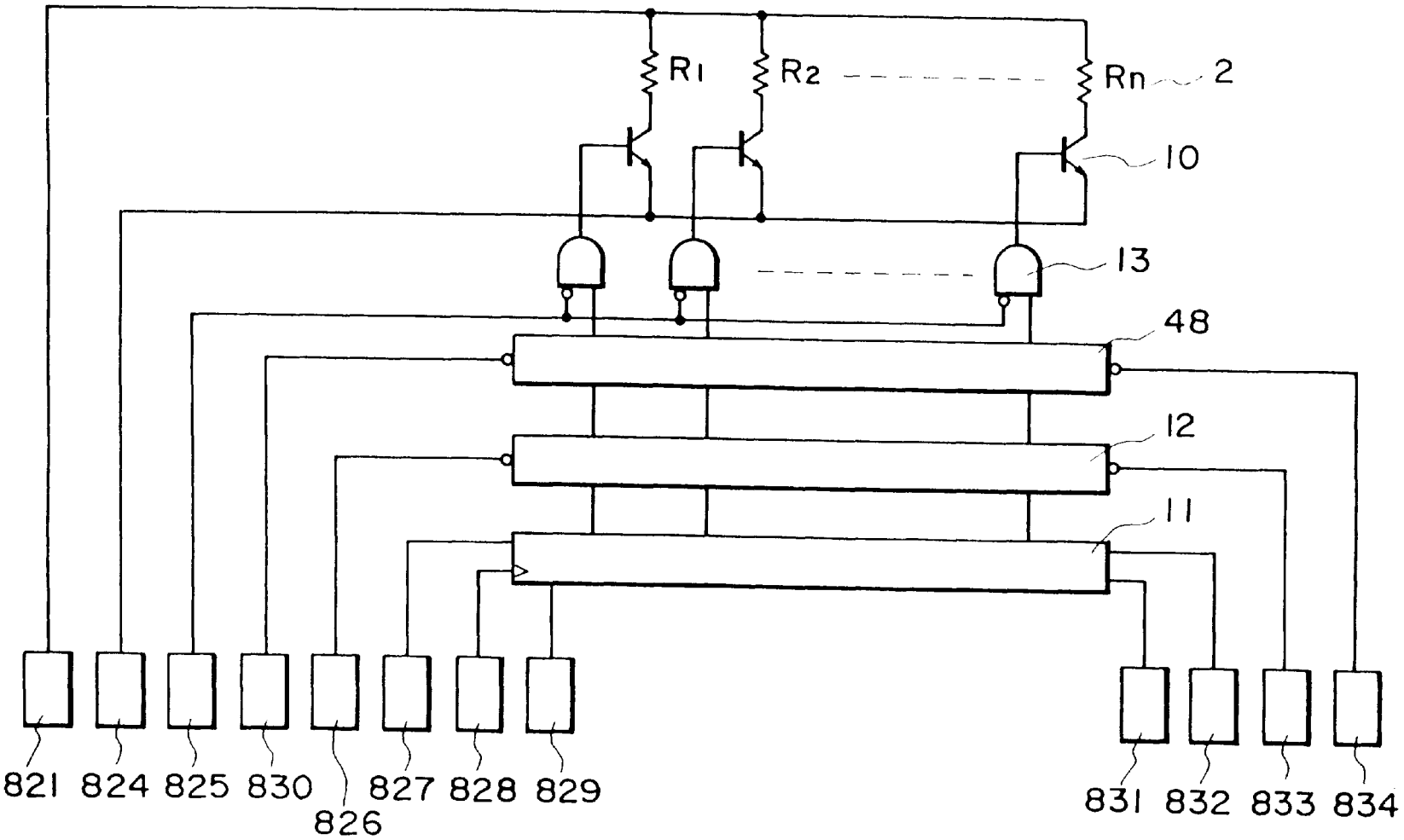
FIG. 18 is s circuit diagram of an equivalent circuit capable of cascade connection, according to an embodiment of the present invention.

In the circuit of FIG. 3, the output timing of the driving signals for the heaters R1–Rn, are simultaneous in synchronism with the strobe signals 14. In the case of the timing chart of FIG. 4, the different timing is usable, when a delay circuit is used as shown in FIG. 18 which will be described hereinafter.

As will be understood from FIGS. 1–4, the minimum required number of pads for the heater board is seven, irrespective of the number of recording elements 2, in this embodiment. Therefore, the complication of the electric wiring attributable to the high density nozzle arrangement, can be avoided.

The following Table 1 gives the minimum required pad numbers on the heater board in relation to the number of ejection heaters, in various driving systems.

TABLE 1

| No. of Heaters | Min. Required No. | | |
|---|---|---|---|
| (m) | Direct Drive | Matrix Drive | This Embodiment 1 |
| 8 | 9 | 6 | 7 |
| 16 | 17 | 8 | 7 |
| 64 | 65 | 16 | 7 |
| 4736 | 4737 | 138 | 7 |

As will be understood from Table 1, when the number of ejection heaters 2 is larger than 16, the number of pads is smaller in this embodiment than in the direct driving system or in the matrix driving system. The advantageous effect is even more remarkable when the number of the heaters increases. When a line head (covering A4 size with 400 dpi) is considered, the number of nozzles is as large as 4736, and therefore, the number difference between the prior art system and the present embodiment system is greatly significant.

Furthermore, in this embodiment, four pads, namely the strobe pad 825, the latch pad 826, the data pad 827 and the clock pad 828 among the seven pads, deal with logic signals, and not in the power supply line, and therefore, the large current does not flow therethrough. For this reason, the size of the electrical leads may be small. The electrical leads therefor can be arranged in smaller space. This permits a larger size electrical leads for the power supply for the heater. Accordingly, even upon the electric current concentration occurred, the electric power loss hardly occurs.

Figure 5:
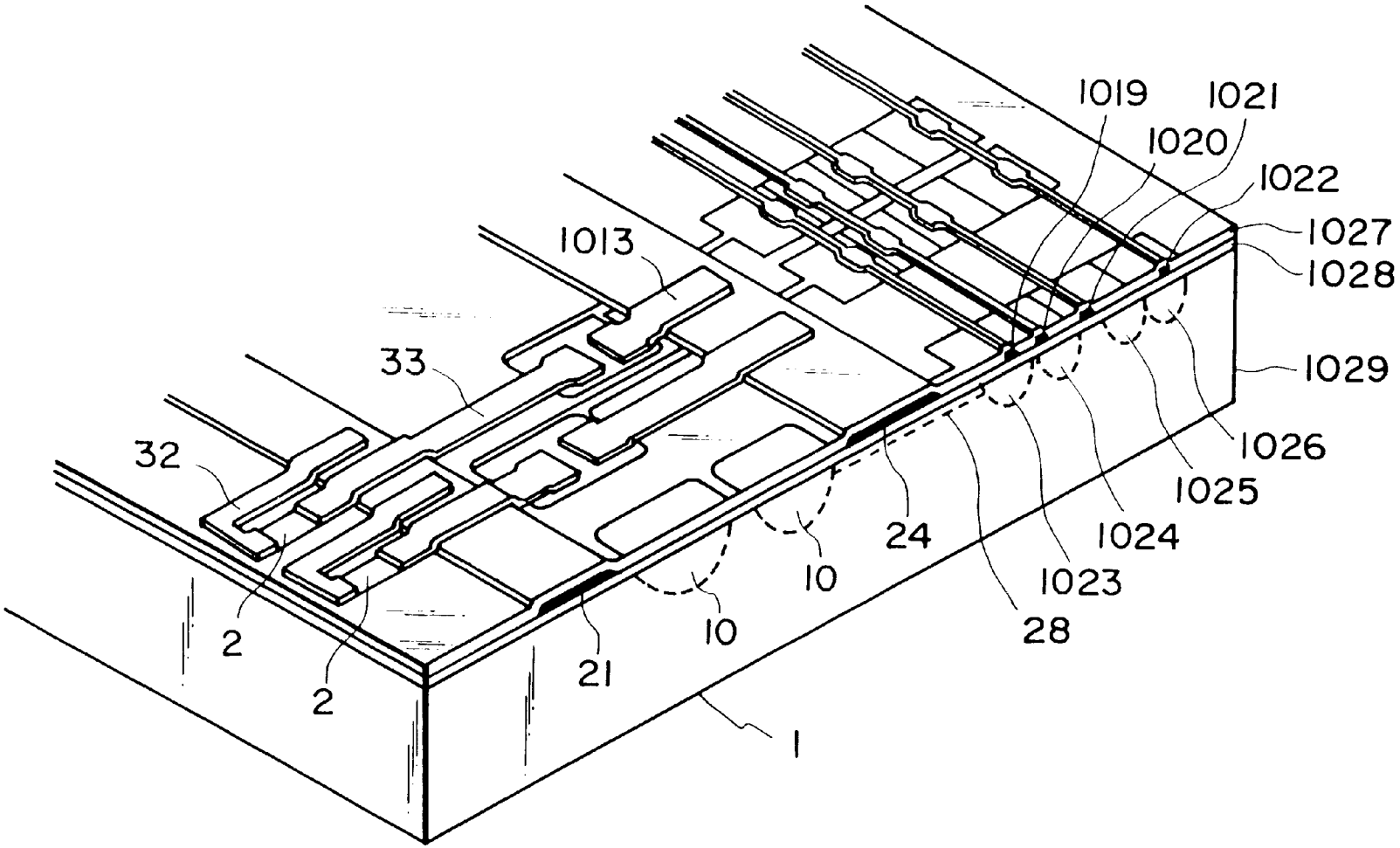
FIG. 5 is a perspective view of a substrate according to an embodiment of the present invention.

Referring to FIG. 5, there is shown a structure of the substrate of FIG. 1 according to an embodiment of the present invention. The basic material of the substrate is usually silicon, but it may be another material if a semiconductor can be formed thereon. The substrate 1 comprises a basic semiconductor layer 1029, and the semiconductive element has been formed through known ion implantation or the like. The semiconductive elements are designated by reference numerals 10, 1016, 1023, 1024, 1025 and 1026. On the semiconductor layer 1029, a first electric insulating layer 1028 is formed, and an electric conductive layer is patterned on the insulative layer. The conductive layer is properly contacted to the semiconductive layer 1029 for establishment of the circuit structure of FIGS. 2 and 3 via through holes (not shown).

The first conductor on the insulating layer 1028 includes VH leads 21 for supplying the electric energy required for bubble creation of the liquid, GND leads 24 for the electric grounding of the leads 21, enabling leads 1019 for actuating the electrothermal transducers 2 at given timing, latch leads 1020 for latching the print data, serial data leads 1021 for supplying the serial data and clock leads 1022 for shifting the serial data at predetermined timing. On the first conductor, there is provided a second insulating layer 1027, and a second conductive layer is provided thereon which is properly contacted via through holes. To the ejection heater 2, the electric energy is supplied through VH-heater lead 32 via a through hole contact. The other end of the heater is connected to a collector of a transistor 10 via through hole of the first insulating layer and through a heater-transistor lead 33. The first transistors 10 and the second transistors 10 are arranged in two lines, but they are staggered to improve the area factor.

When, for example, the heater arrangement pitch is small, the transistor are arranged in plural lines since the area factor is better if the configuration of the transistor is close to right square. The other end of the transistor 10 (base) is connected to the logic gate 1023 via transistor base line 28. The transistor base lead 28 is made of polysilicon or the like. As for the first and second conductive layer material, aluminum or other low resistance material is used. The other end (emitter) of the transistor 10 is connected to the GND lead 24 via through hole and through the transistor-GND line. The logic gate 1023 selectively transmits ON-signal to the transistor through the enabling line 1019.

Because of the driving nature of the enabling line 1019, the electrothermal transducer elements 2 are independently actuatable. The current flowing through the enabling line 1019 is very small, and therefore, the power loss is small even if the wiring thereof is complicated, and therefore, the ejection heaters 2, can be selectively actuated.

Figure 6B:
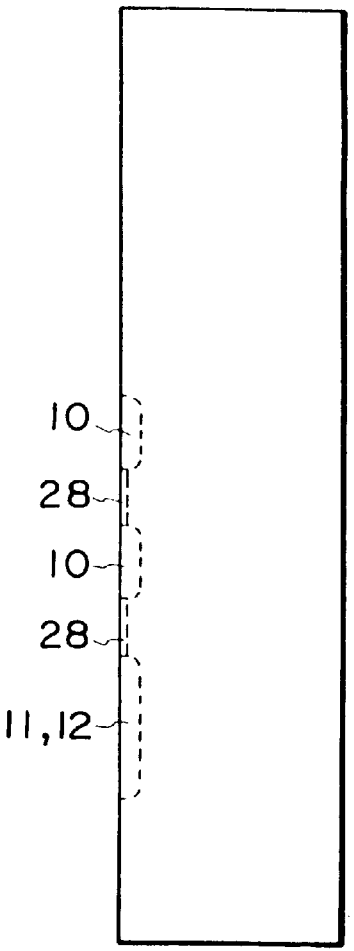
FIG. 6 illustrates manufacturing process for the substrate, according to an embodiment of the present invention.
Figure 6A:
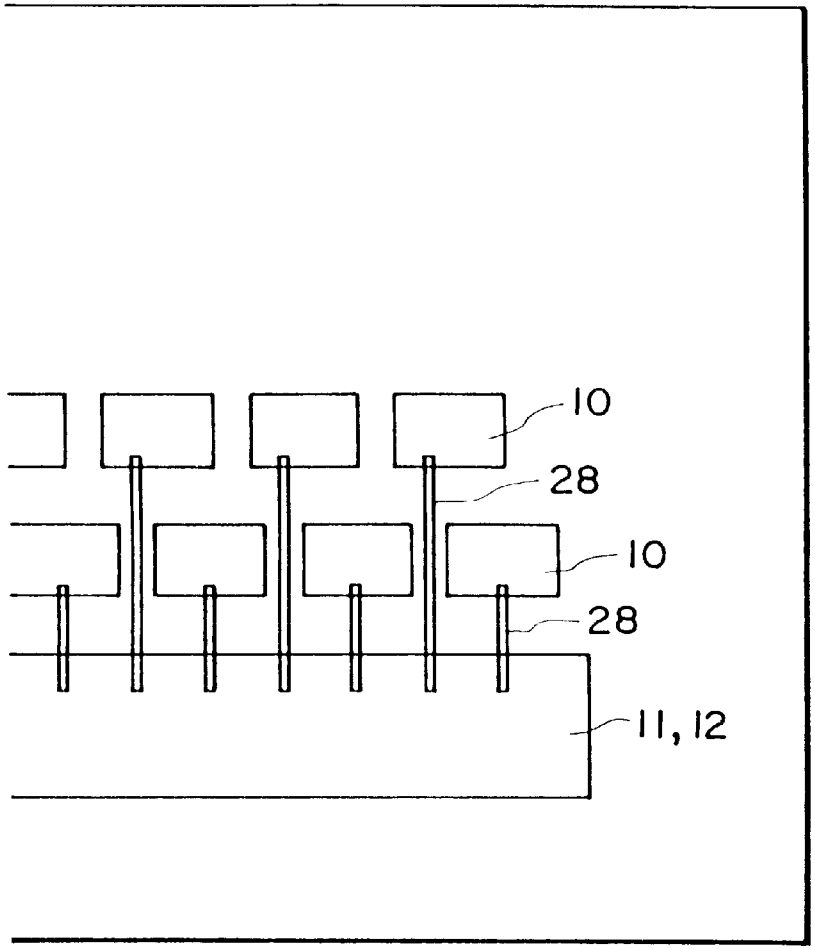
Figure 7A:
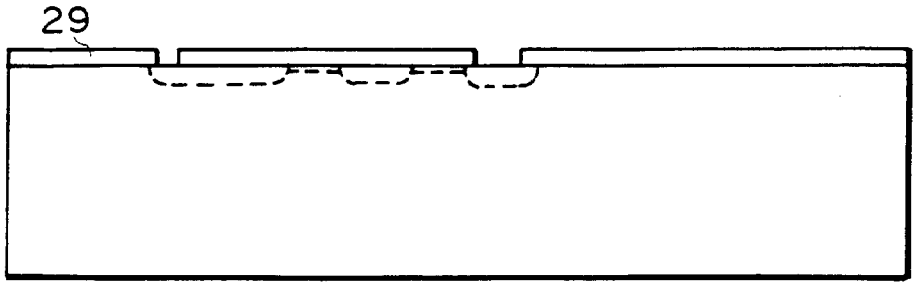
FIG. 7 illustrates manufacturing process for the substrate, according to an embodiment of the present invention.
Figure 7B:
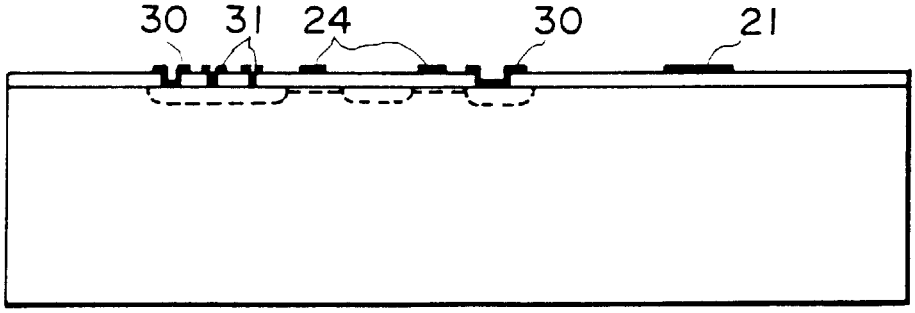
Figure 7C:
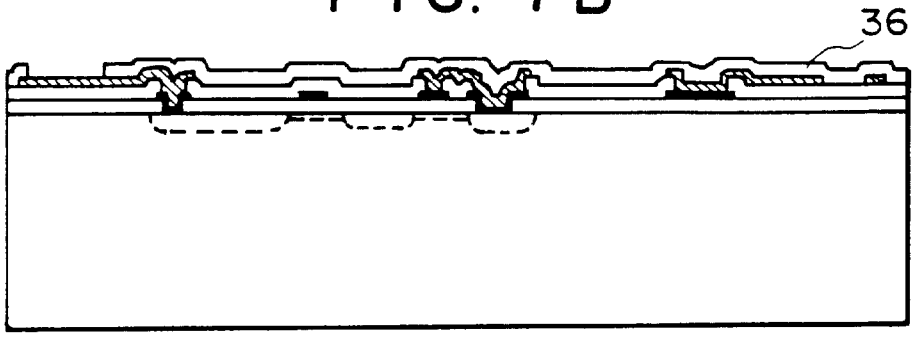
Figure 7D:
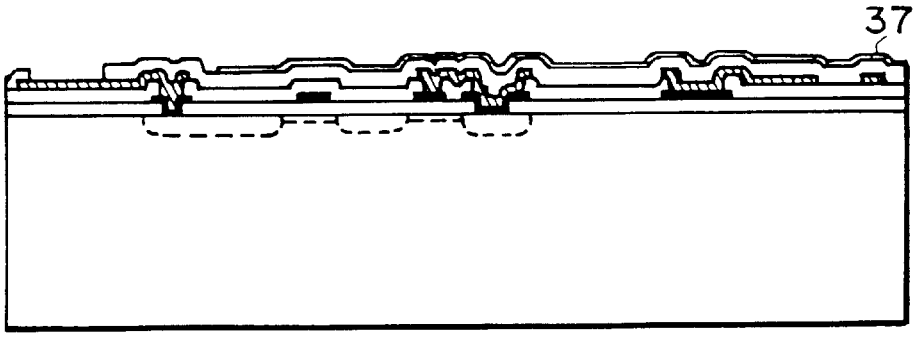

Referring to FIG. 6, an example of manufacturing process of the substrate 1 shown in FIG. 5, will be described. This Figure illustrates the process steps after the latching circuit 12, the shift register circuit 11 and the transistors 10 and the like have been manufactured through ion implantation or diffusion. In FIG. 6, designated by (a) is a top plan view, and (b) is a partial sectional view.

In this embodiment, the signal line for actuating or deactuating the transistor by application of logic signals from the shift register 11 to the transistor 10, are provided by the semiconductive layer. This is permitted because the electric current between the shift register 11 and the transistor 10 is very small, and therefore, there is no need of providing electric lines for this purpose.

Further, in the structure of the substrate of this embodiment, the transistors 10 are staggeredly arranged as shown in FIG. 6(*a*) with alternatingly different distances from the shift register, thus increasing the pattern integration. In the case of the substrate for the ink jet recording head or apparatus, the electric current flowing to the recording element through the transistor is large, which requires large area transistors. However, from the standpoint of high resolution recording, the distance between adjacent recording element is desired to be small. The staggered arrangement permits both requirements. In this embodiment, the distances from the shift register to the transistor is changed in two steps, but a larger number of steps is usable.

Figure 8B:
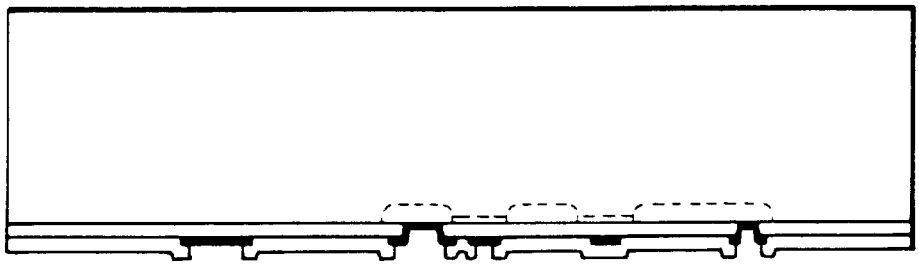
FIG. 8 illustrates manufacturing process for the substrate, according to an embodiment of the present invention.
Figure 8A:
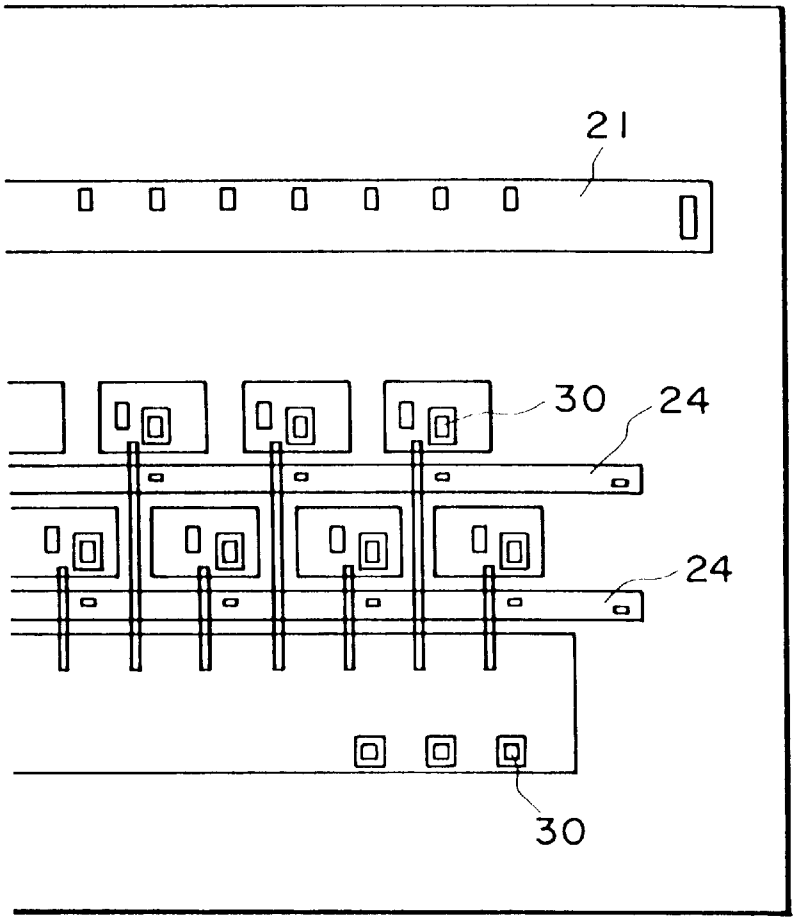
Figure 9B:
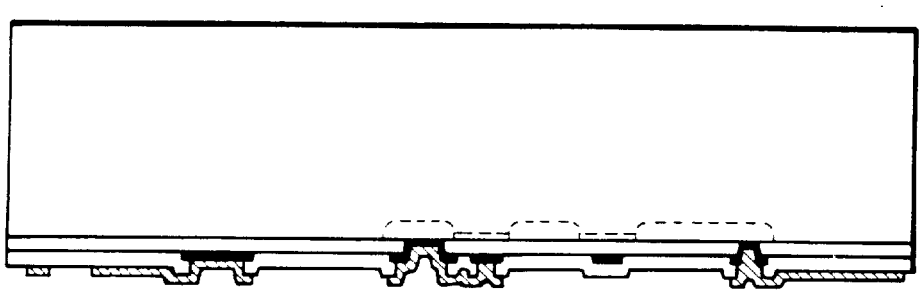
FIG. 9 illustrates manufacturing process for the substrate, according to an embodiment of the present invention.
Figure 9A:
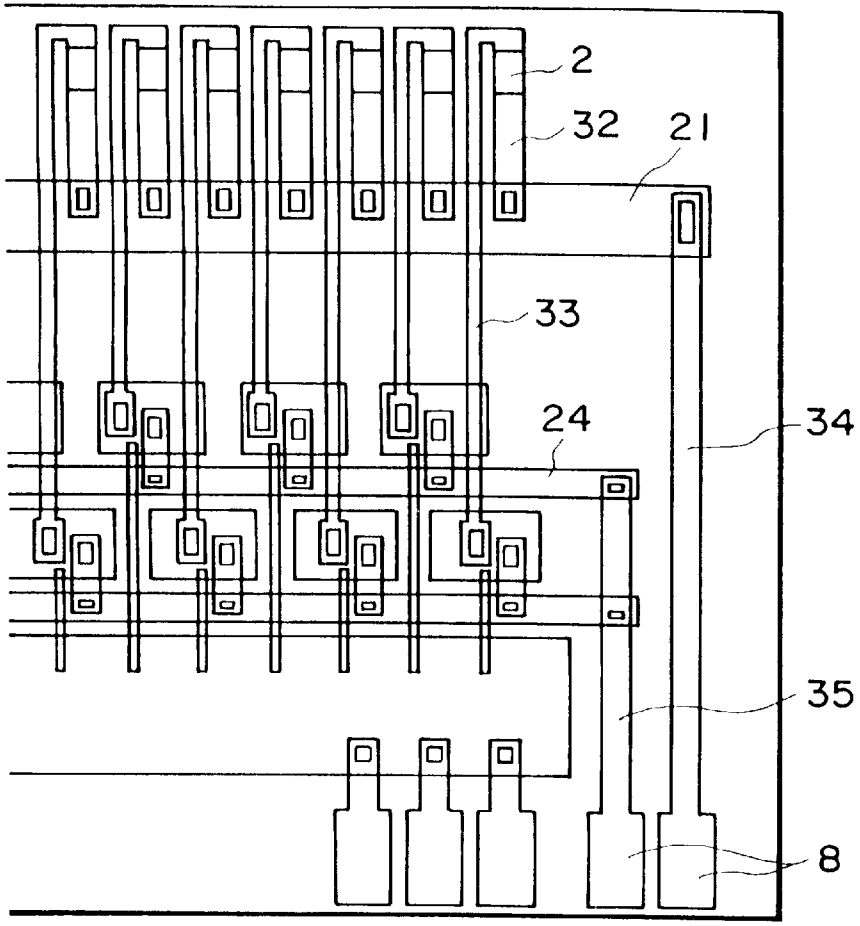

FIGS. 7, 8 and 9 show the manufacturing steps, and the manufacturing steps proceeds in the order of (a), (b) of FIG. 7, FIG. 8, FIG. 9, (c) and (d) of FIG. 7.

In FIG. 7, (a), $SiO_2$, SiN or the like between-layers insulating film 29 is formed on the substrate shown in FIG. 6, and through holes have been formed for the electric connection with the upper layer.

In FIG. 7, (b), the first lines are formed with aluminum or the like for the VH common electrode 21, the grounding line 24, the logic line 31, for the contact 30 or the like.

As shown in FIG. 8 by (a), (b), a second $SiO_2$ or SiN ($Si_3N_4$) or the like between-layers insulating film is formed on the first wiring layer, and through holes are formed therein. On the second insulating film, a second aluminum layer is formed, and is patterned, so that the electric connections between the electrothermal transducers 2 and the VH electrode and the transistors, and the pads, are formed (FIG. 9).

Subsequently, in order to avoid the short circuit between electrodes through the ink, a protection layer 36 is formed, as shown in FIG. 7, (c). On the protection layer, an anti-cavitation layer 37 made of Ta or the like may be formed, as shown in FIG. 7, (d). The anti-cavitation layer 37 functions to protect the electrodes and the other layers from cavitation liable to occur bubble creation and collapse in the ink.

Figure 10:
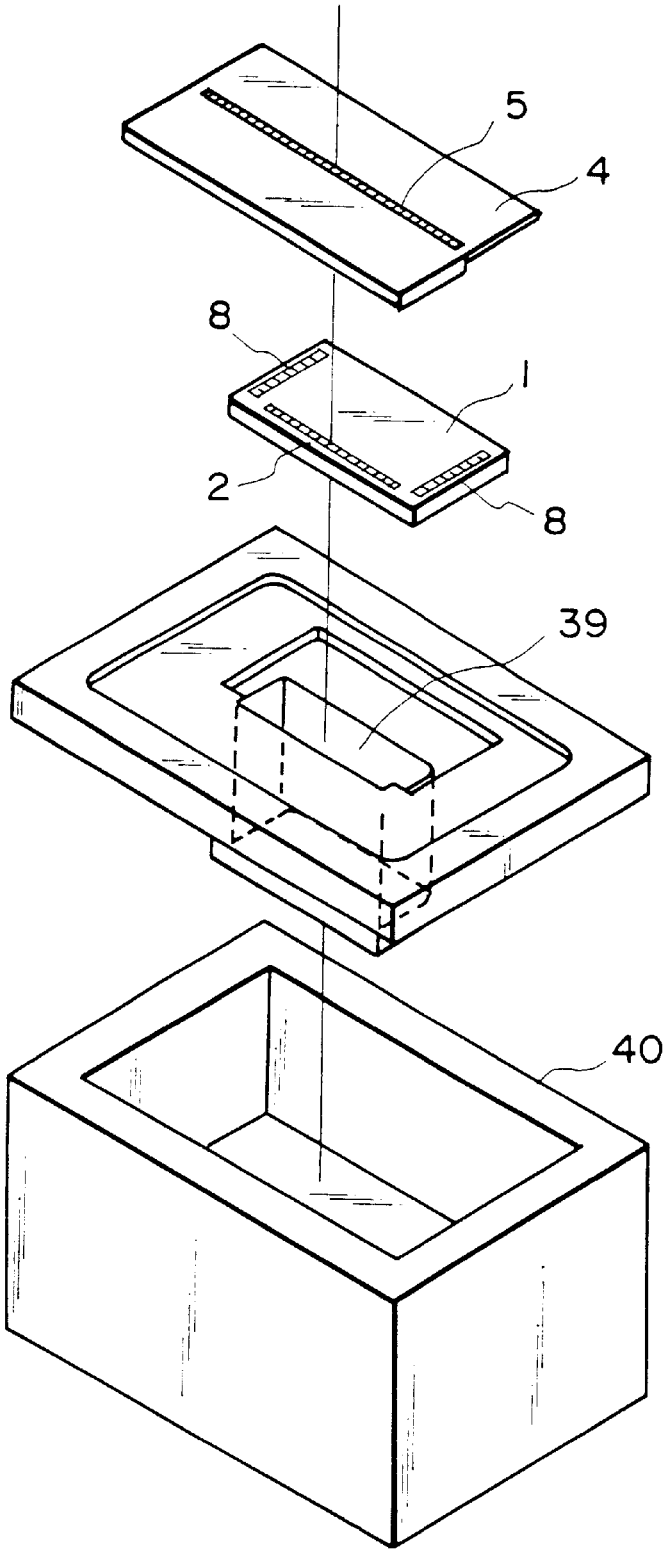
FIG. 10 is an exploded perspective view of a recording head cartridge using the substrate of FIG. 1.

Referring to FIG. 10, the description will be made as to the structure of the ink jet head using the heater board 1 described above. A top plate 4 includes n orifices 5 and grooves in communication therewith, respectively, although not shown in the Figure. When the top plate 4 is combined with the heater board 1, n recording elements 2 correspond to the respective grooves, and therefore, the respective orifices, and in addition, the ink chamber is formed. The electrical pads 8 are disposed in marginal portions of two sides of the heater board 1. They are connected to the external lines for reception of the electric energy, and are connected therewith through wire bonding, gang bonding, bumping, clamping or the like.

Figure 11:
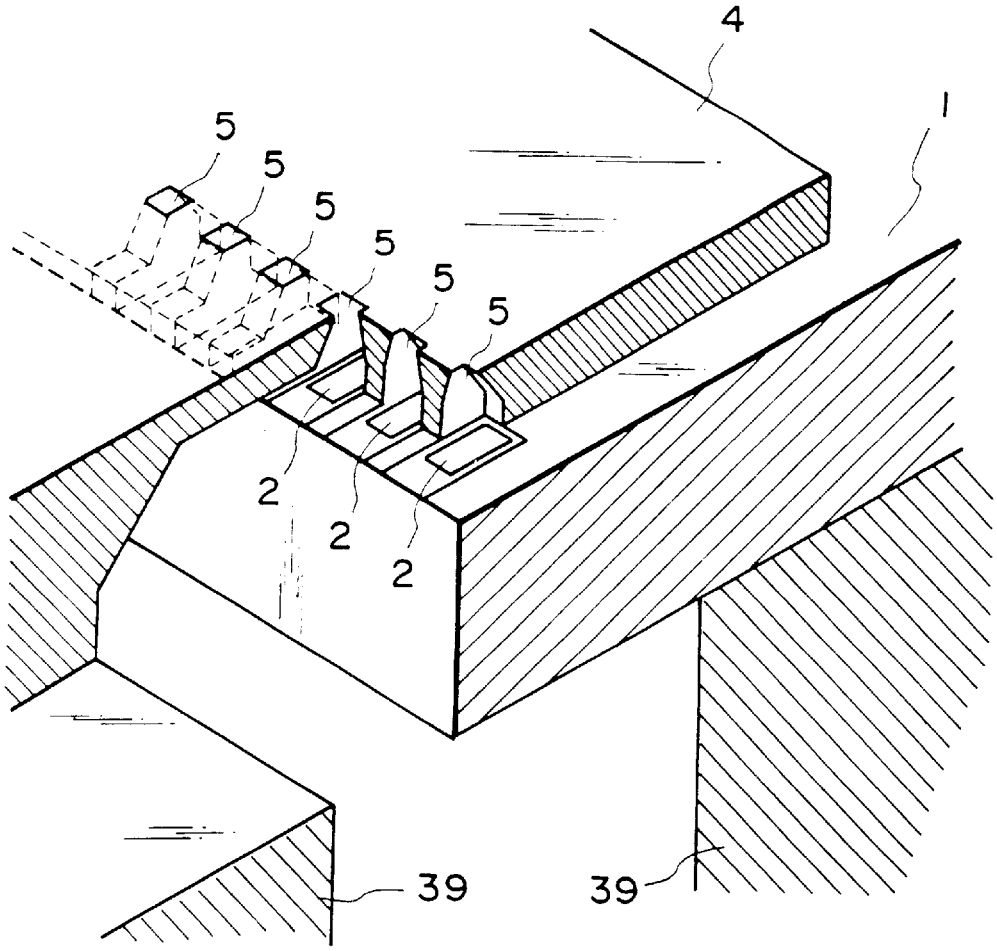
FIG. 11 is a sectional view of the substrate of FIG. 10 around a nozzle.
Figure 12:
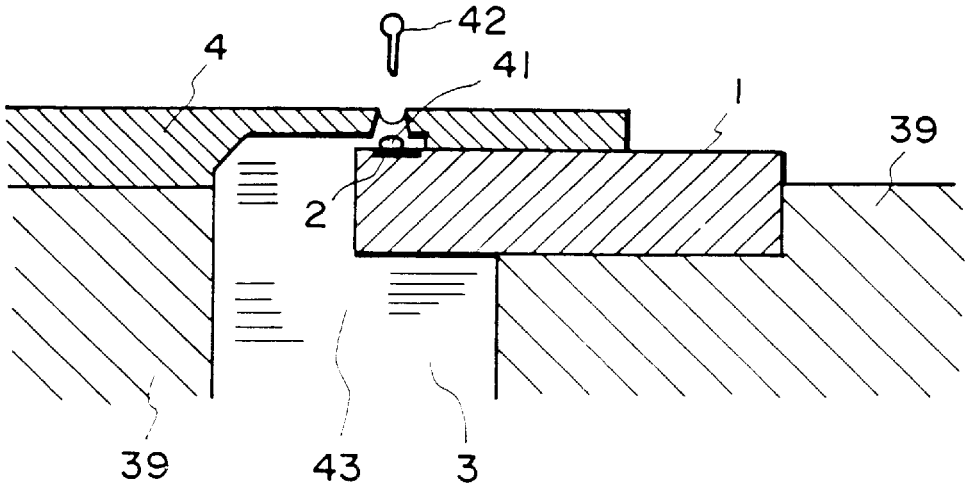
FIG. 12 is a sectional view of the substrate of FIG. 10 around a nozzle.

The member constituted by the top plate 4 and the heater board 1 is mounted on an ink container cover 38. The ink container cover is combined with an ink container case to constitute an ink container for accommodating the ink therein. In the ink container, an ink absorbing material may be contained to retain the ink therein, although not shown. The ink is supplied to the nozzle through an ink supply passage of the ink container cover 39 through a bottom portion of the recording element array 2 of the heater board 1. This is best seen in FIG. 11 which is a sectional view. The ink is supplied to the backside of the heater board 1 adjacent the position where the recording elements 2 are arranged, through the supply passage formed in the ink container cover 39. Then, the ink reaches to the surfaces of the individual recording elements through the nozzles of the top plate 4. Here, the ink is heated by the ejection heater 2 so that a bubble is created. By the pressure of the bubble creation, the ink is ejected out through the orifices 5 onto the recording material to form dots. As shown in FIG. 12, the ink is supplied to the surface of the ejection heater 2, the droplet of the ink 42 is ejected by the pressure resulting from the bubble creation 41.

The ink supply around the backside of the substrate at the position having the recording elements, the non-uniform temperature distribution of the substrate is decreased, thus stabilizing the recording action. In addition, the distance between the recording element position and the ink supply chamber 43 can be decreased to the minimum, and therefore, the ink refilling speed can be increased, thus accomplishing the high speed response of the ink ejection.

The back wave described hereinbefore can be diffused firstly because the distance is short between the bubble creating position (recording element position) and the common chamber 43 position and secondly because the diffusing rate of the configuration of the passage to the liquid chamber 43 can be increased. Thus, the cross-talk attributable to the production of the back wave between nozzles, can be minimized. In order to assure these advantageous effects, the recording elements are preferably disposed within 1000 microns from an edge of the substrate, and further preferably, it is within 300 microns. Here, the position of the recording element is determined on the basis of the distance from an end of the common liquid chamber to the center of the recording element in the direction along the liquid passage.

In the foregoing embodiments shown in FIGS. 10–12, the ink jet recording head using the substrate is of the type wherein the ink is ejected in the direction substantially perpendicular to the surface of the recording element.

Figure 13:
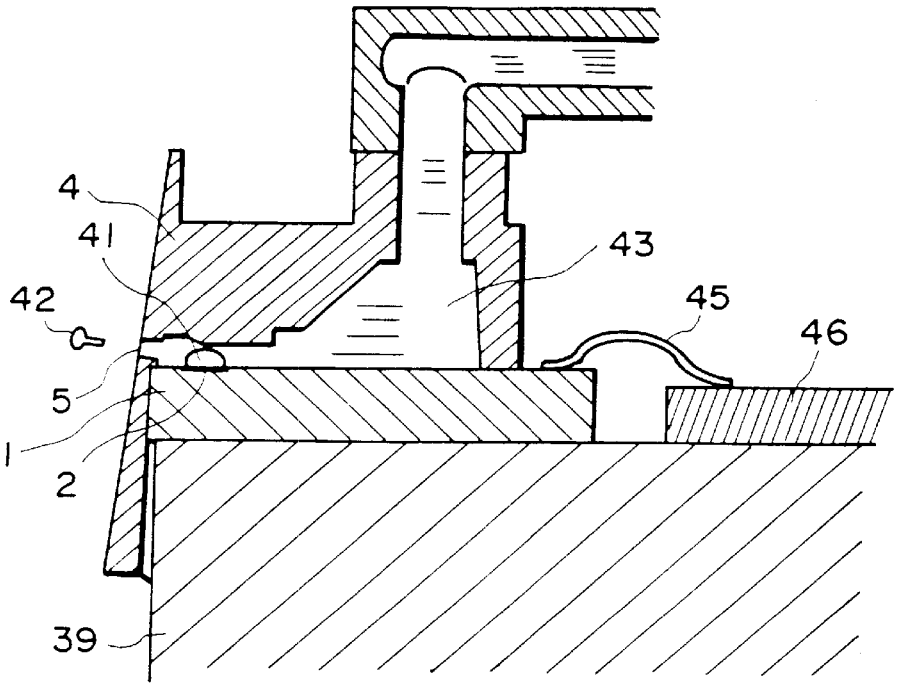
FIG. 13 is a sectional view of a recording head using the substrate of FIG. 1.
Figure 14:
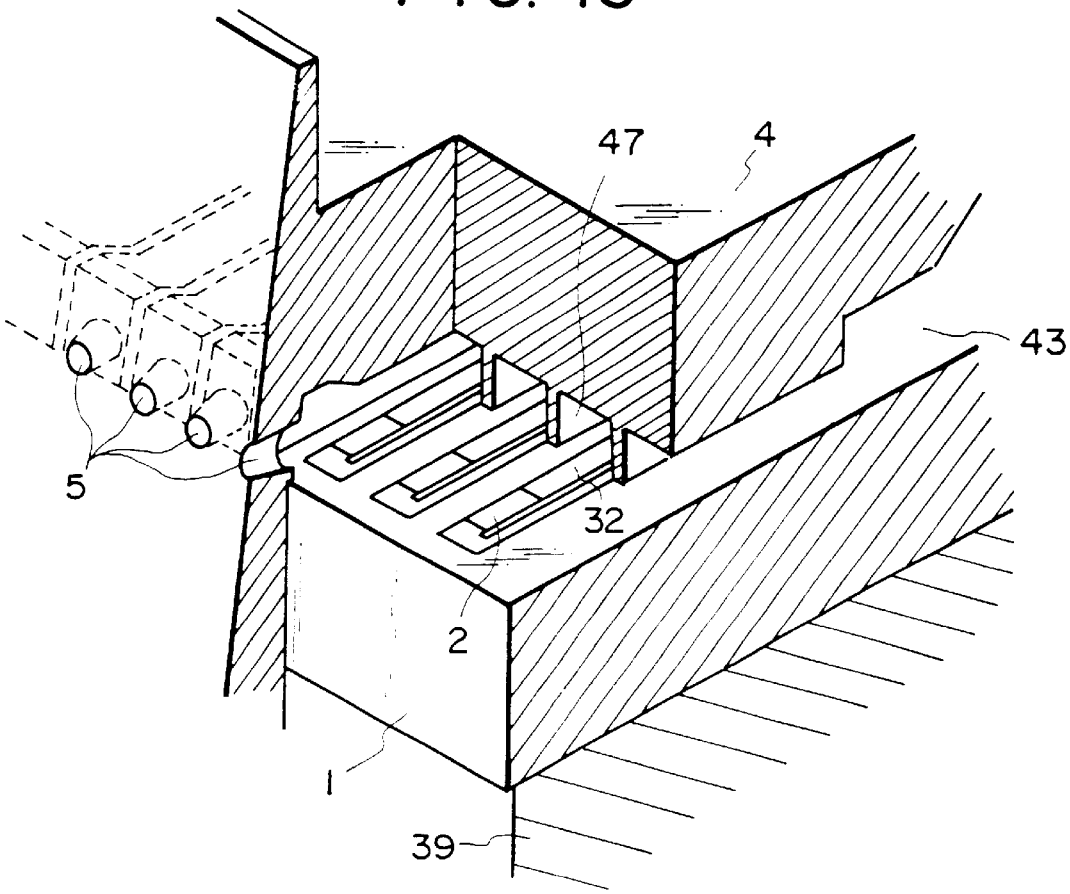
FIG. 14 is a sectional view of a recording head using the substrate of FIG. 1.

Referring to FIGS. 13 and 14, there is shown an example of the recording head in which the ink is ejected in the direction parallel to the surface of the recording element. FIG. 13 is a partial sectional view thereof, and FIG. 14 is a sectional view.

In the Figure, a top plate 4 having grooves for constituting liquid passages 47 is joined with the substrate 1. The ink is supplied to the liquid passages 47 from the common liquid chamber 43, and the ink is supplied to the orifice by capillary force. The electric signals are applied to the recording elements corresponding to the liquid passages 47, and heat is generated by the corresponding recording elements. Then, the ink is heated, and a bubble 41 is created. By the pressure caused by the bubble creation, the ink is ejected through the ejection outlet 5. To the substrate according to this embodiment, having the shift register, recording electric signals are supplied through the wire bonding pads 45 from a print board 46.

Figure 15:
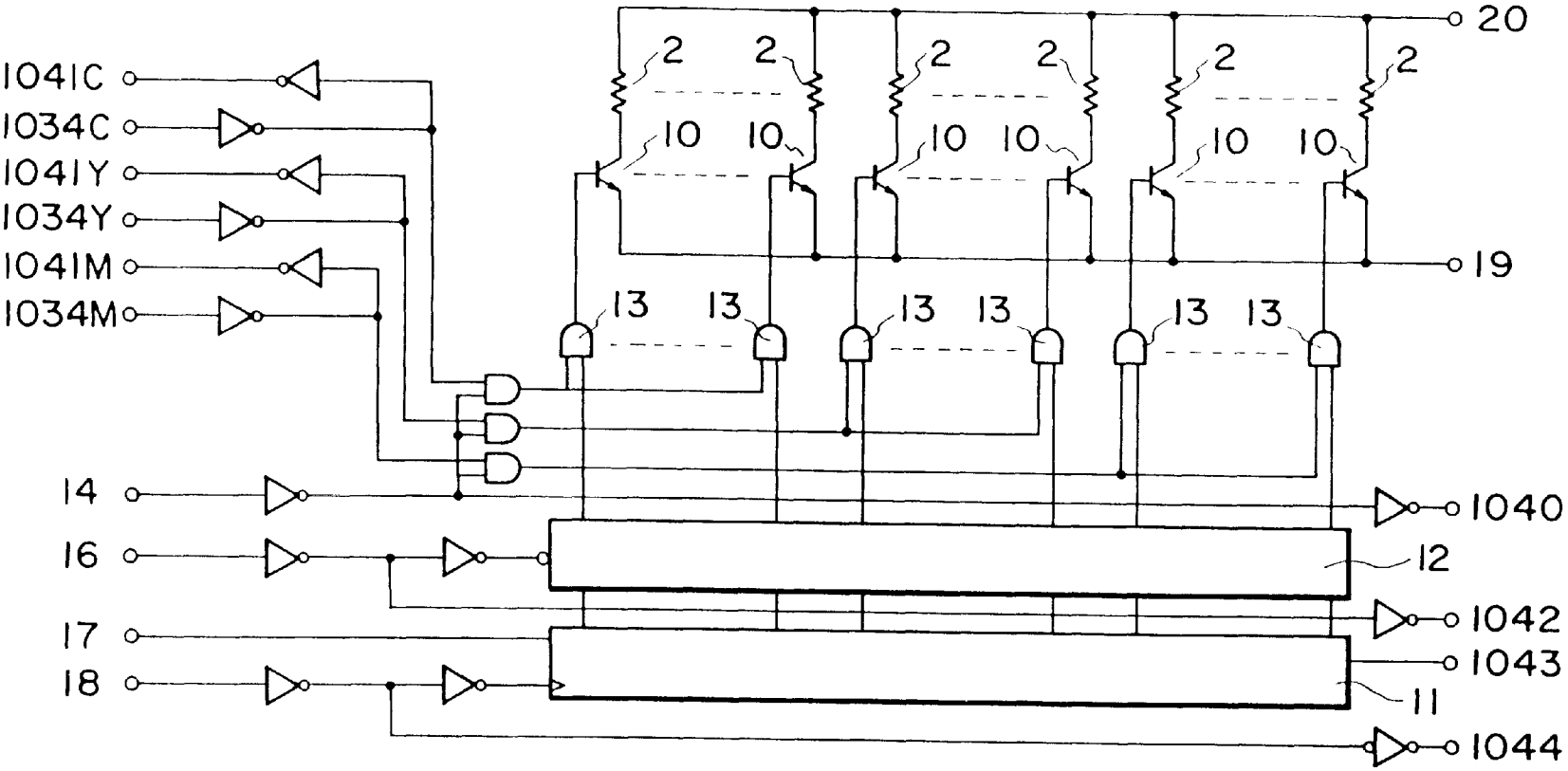
FIG. 15 is a circuit diagram in a conventional color recording apparatus.

FIG. 15 is a circuit diagram of the recording head element substrate capable of color recording, according to an embodiment of the present invention. The recording elements 2C, 2Y and 2M are for cyan, yellow and magenta recording actions. Several tens of the recording elements are used. Function element 10 are the same as described in the foregoing. A shift register circuit 11 functions to align the image data in relation to the recording elements. It is directly connected with a latching circuit 12 for holding the data for the recording elements the strobe signal 14 is capable of controlling the on-period for the recording element. The signals 1034C, 1034Y and 1034M is capable of activating independently the respective color function element blocks. An output is provided from an AND gate receiving the strobe signal 14 and the signal 1034C, 1034Y, 1034M. The output of the AND gate is supplied to an additional AND gate, which also receives an output of the latching circuit. The output of the additional AND gate permits electric power supply to the recording element for the period during the outputting time. According to this embodiment, a small and low cost recording apparatus can be achieved by forming plural color recording elements on the semiconductor chip (substrate).

Figure 16:
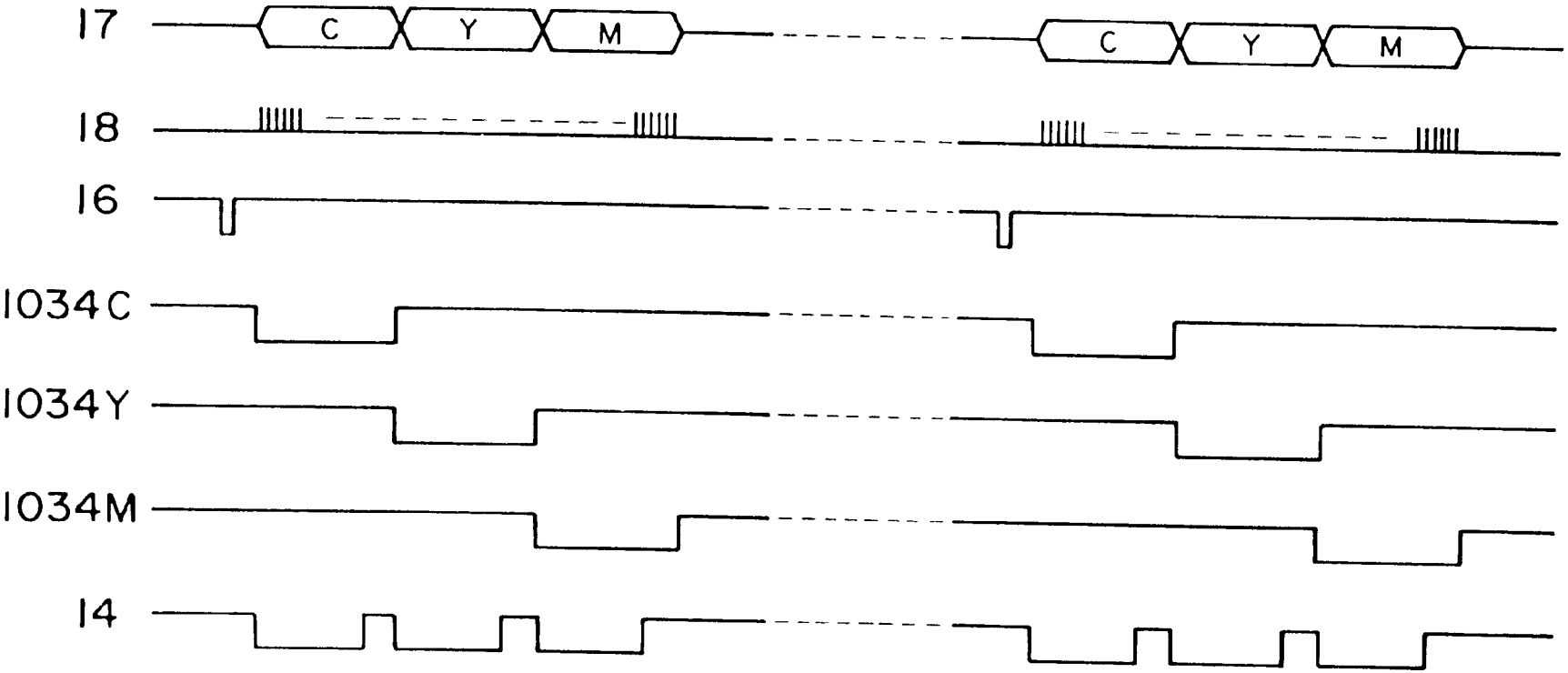
FIG. 16 is a drive timing chart for a color recording apparatus to which the present invention is applicable.

FIG. 16 is a drive timing chart of a recording apparatus according to the embodiment of the present invention. One of the features of this embodiment is that the image data for plural colors are serially supplied at the time of the image data signal (SI) supply. In other words, the image data for plural colors are not separately supplied, but is sequentially and serially supplied to a single image data signal input terminal 17 for the cyan, yellow, magenta (black may be added) colors. The serial image data for plural colors are sequentially transferred in the shift register 11 with the aid of transfer clock (SCK), so that the image data for the plural colors are aligned for one line of the recording elements for the respective recording heads. The shift register 11 shown in FIG. 15 is electrically connected with the latching circuit 12 to permit electric power supply to the recording elements in relation to the image data for the one period of the latch pulse signal (LAT) 16.

Actually, the recording elements are driven dividedly for the respective colors, in the periodical time duration capable of driving the recording elements. The dividing operation is carried out in response to enabling signals 1034C, 1034Y and 1034M. By the use of this signal and the strobe signal 14 for determining the driving period which is proper for the respective colors (the actuating pulse widths matching the respective recording elements), the recording element blocks divided for the plural colors, can be selectively driven with constant pulse widths during the periodical time duration determined by the latching pulses.

Because of the use of the drive timing described above, even if the recording operation is carried out in plural colors, there is no need of providing respective signal lines for the colors, so that the number of electrical leads and the number of pads can be reduced. Therefore, the size and cost of the recording head substrate and the recording head, can be provided. In the foregoing description, the case of three color recording is taken. However, the similar driving method can be used for a larger number of colors, or for mono-color recording.

In the case of the monochromatic recording, the same structure as in the color recording is usable. By doing so, both of the color recording operation and the monochromatic recording operation are enabled only if the recording head is exchanged. As regards the discrimination between the color recording and the monochromatic recording, a discriminating code may be provided in the serial data, and the data is fed back from the recording apparatus to the printer. It is a possible alternative that the recording head may be provided with a cut-away portion which is detected by the printer.

Figure 17:
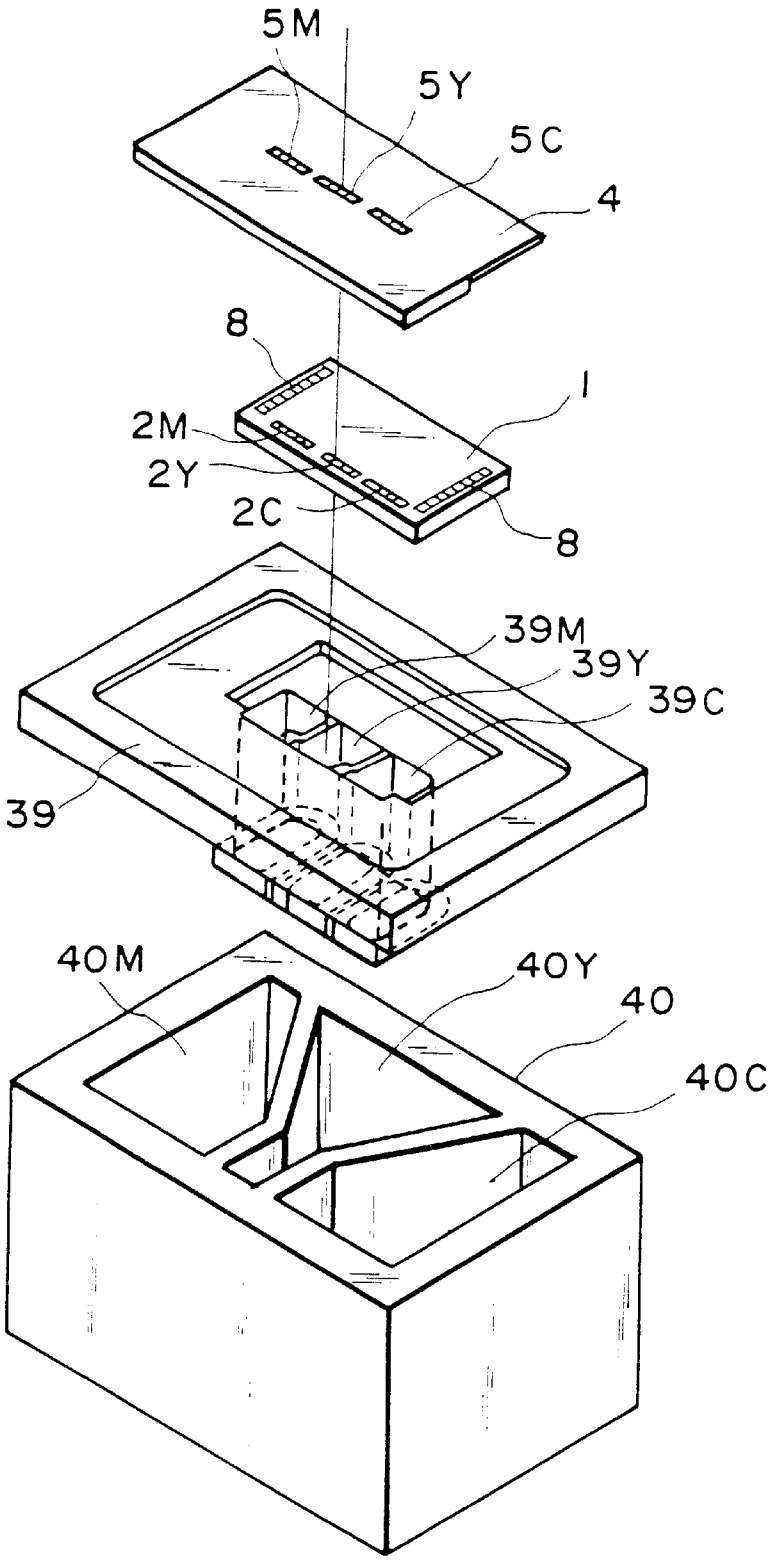
FIG. 17 is a exploded perspective view of a color liquid jet recording apparatus to which the present invention is applicable.

FIG. 17 shows an embodiment in the form of a color recording head cartridge, in which the advantageous effects of the present invention are best used. A top plate 4 is provided with ejection outlets 5M, 5Y and 5C for magenta, yellow and cyan colors, respectively and with grooves for constituting passages connected therewith. A semiconductor chip (substrate) 1 has plural recording elements, function elements and driving integrated circuits integrally on the surface thereof. The surface thereof is provided with electric pads 8 for connection with the respective color recording elements 2M, 2Y and 2C and for connection with power source. The common chamber 39 for supplying the ink materials to the respective ejection outlets, are divided in this example into the common chambers 39M, 39Y and 39C, for the respective colors. The ink supplying common chambers 39M, 39Y and 39C are ink supply containers 40M, 40Y and 40C, respectively. In this embodiment, the size and cost are reduced. The fundamental mechanism and the operation of the recording head of this embodiment is the same as those of FIG. 10 embodiment, and therefore, the detailed description thereof is omitted for simplicity.

Here, an example of the recording head in which the ink is ejected in the direction substantially perpendicular to the surface of the recording element, is taken. However, this embodiment is applicable to the recording head of the type shown in FIGS. 13 and 14, in which the ink supply system is divided for the respective ink colors.

In the embodiment, the elements for the respective colors are formed on a single substrate for the color recording head. However, plural substrates may be cascade-connected to meet the color demand the long recording head demand.

Figure 19:
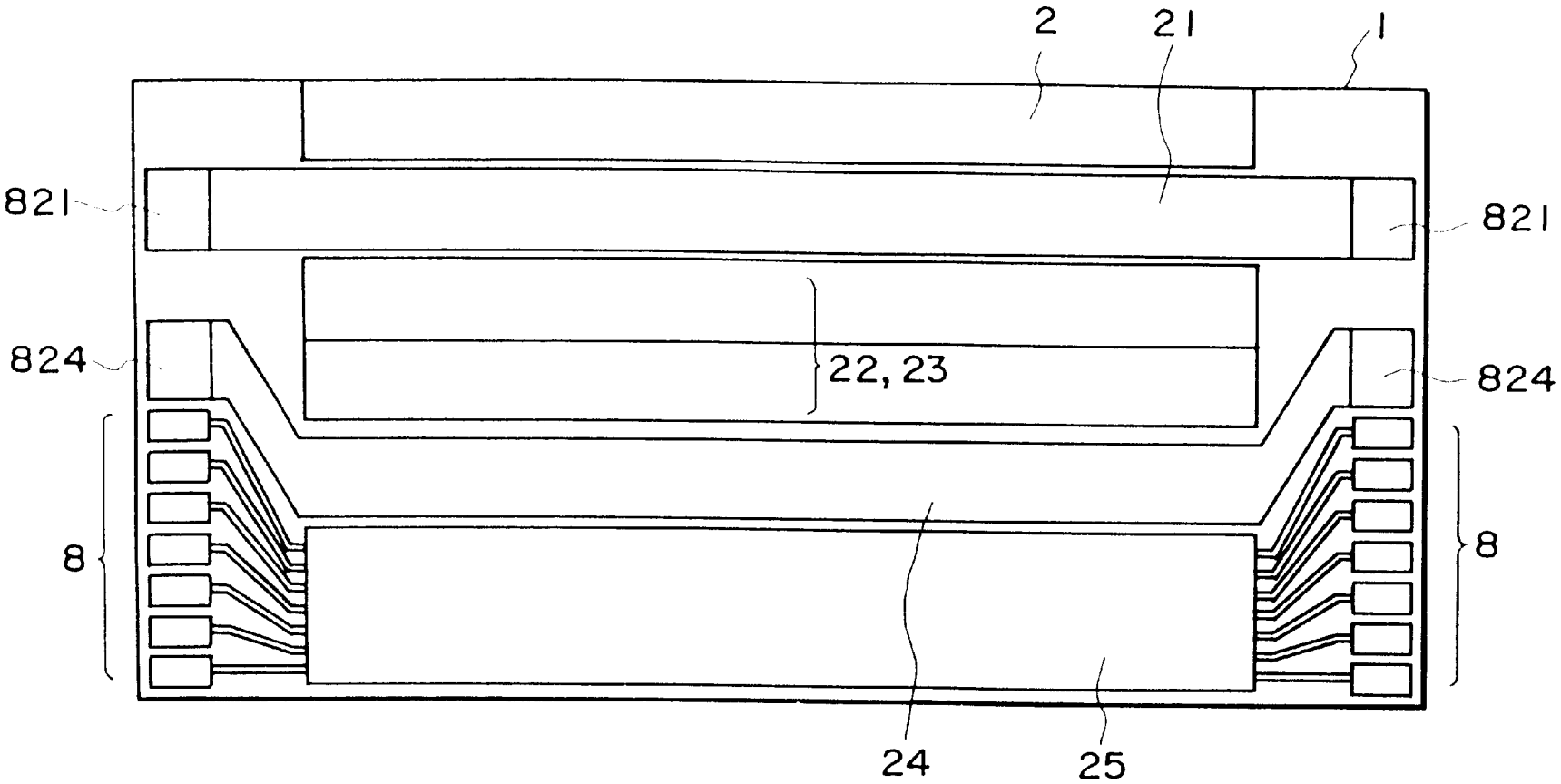
FIG. 19 is a top plan view of a substrate capable of cascade connection, according to an embodiment of the present invention.

FIG. 18 shows an equivalent circuit in the wiring of the substrate which is cascade-connected with another substrate. FIG. 19 shows a substrate having such a circuit.

As contrasted to the case of FIG. 3, output contacts 831–833 are provided for the cascade connection for the latching circuit 12 and the shift register 11, as contrasted to FIG. 3 embodiment. The substrate is connected with another substrate through the output contacts. By doing so, plural substrates may be driven by a data input signal required for driving one element substrate. In this case, to the driving operation is substantially the same as in the foregoing embodiment.

Conventionally, in the case of the substrate or recording head having a large number of recording elements, the manufacturing cost is quite increased for the purpose of increasing the yield. However, according to this embodiment, the number of connecting lines can be reduced even when plural substrates are connected to increase the number of recording elements into an elongated recording head as in a full-line recording head, and the manufacturing cost and the design and manufacturing easiness, can be maintained.

In FIG. 19 embodiment, the number of output contacts is larger than that in the equivalent circuit of FIG. 18. However, this results from having made the strobe signal lines or the like common with the other substrate. As to how many lines are made common, it is determined in consideration of the entire design of the recording head by one skilled in the art.

Figure 20:
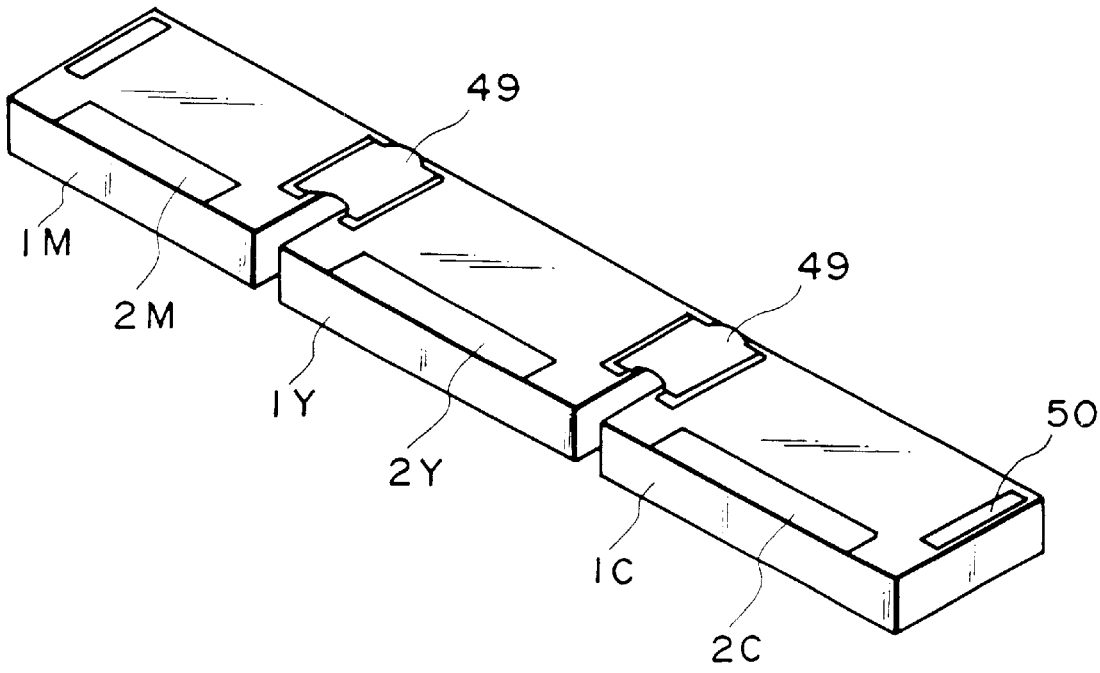
FIG. 20 is a perspective view of semiconductor chips for a recording apparatus which have been cascade-connected, according to an embodiment of the present invention.
Figure 21:
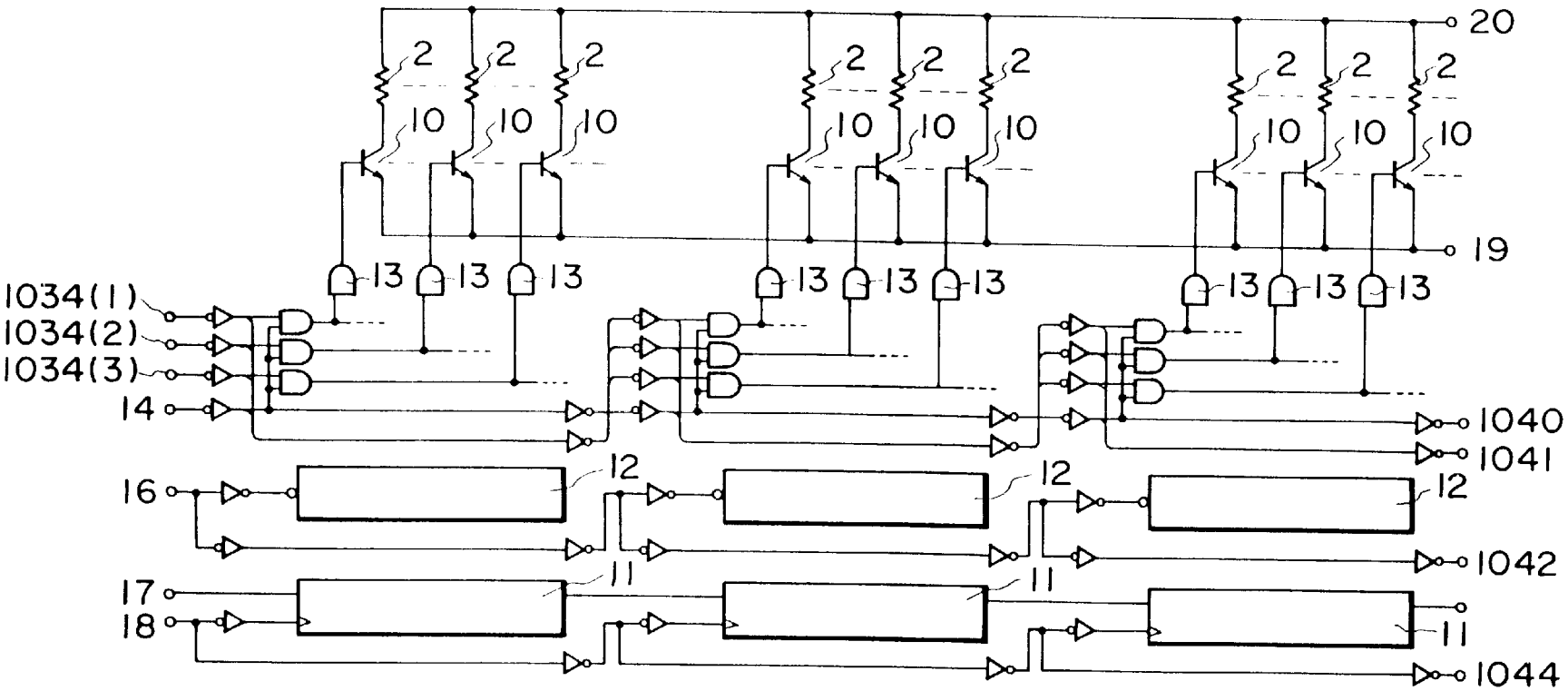
FIG. 21 is a circuit diagram illustrating the cascade connection in a color recording apparatus to which the present invention is applicable.
Figure 22:
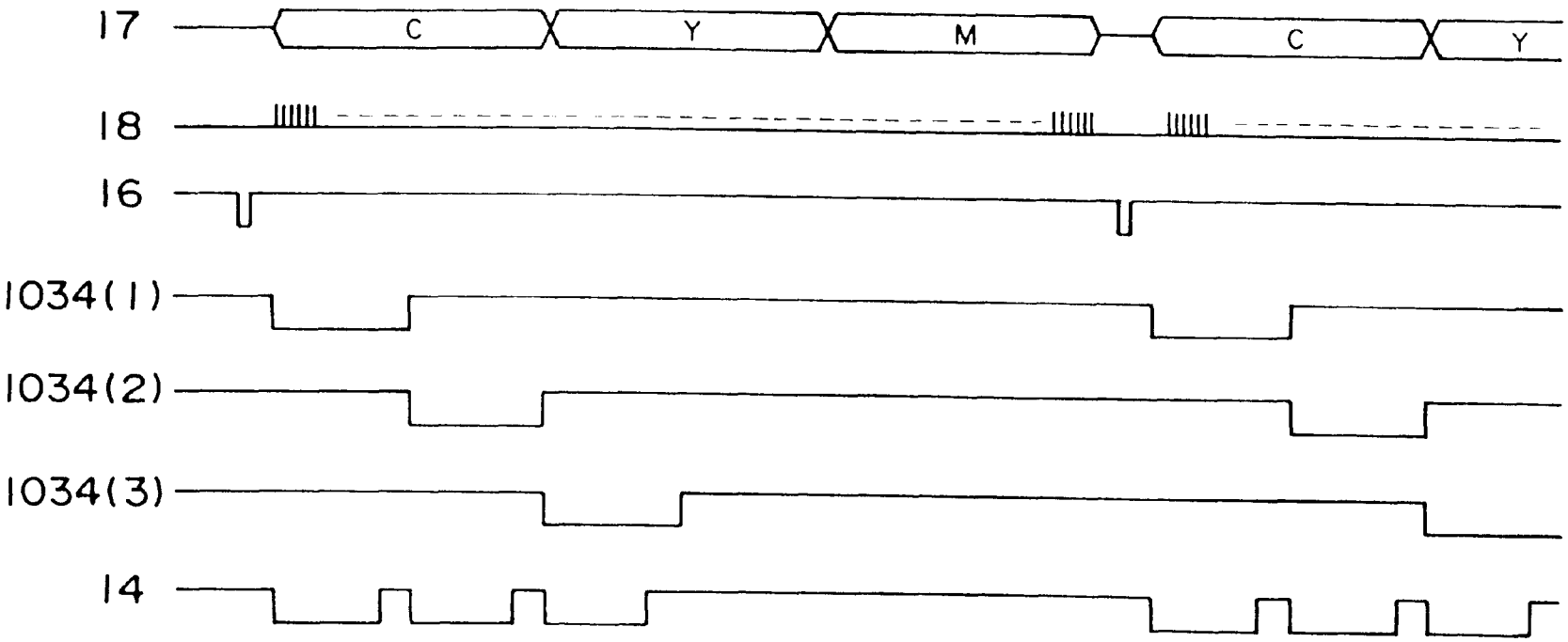
FIG. 22 is a timing chart for the circuit of FIG. 21.

FIG. 20 shows an embodiment in which the semiconductor chips or substrates as described hereinbefore are cascade-connected in relation to the colors, and still the high speed printing is possible. The connecting pads 8 of the semiconductor chips 1M, 1Y and 1C for the respective colors, are cascade-connected with connecting elements (or wire bonding or the like) 49. FIG. 21 shows a circuit diagram of this structure. Basically the contacts for the power supply are made common, and the signal line contacts are cascade-connected. The equivalent circuit for the respective colors in this embodiment is substantially the same as in FIG. 15 embodiment, and therefore, the detailed description thereof are omitted for simplicity. When the cascade-connection is made, the image data corresponding to the total number of recording elements, are serially supplied for the respective colors in the case of the color recording, and in the case of the monochromatic recording, the monochromatic data corresponding to the total number of recording elements are serially supplied. FIG. 22 is a drive timing chart for driving the recording apparatus of this embodiment.

Figure 24:
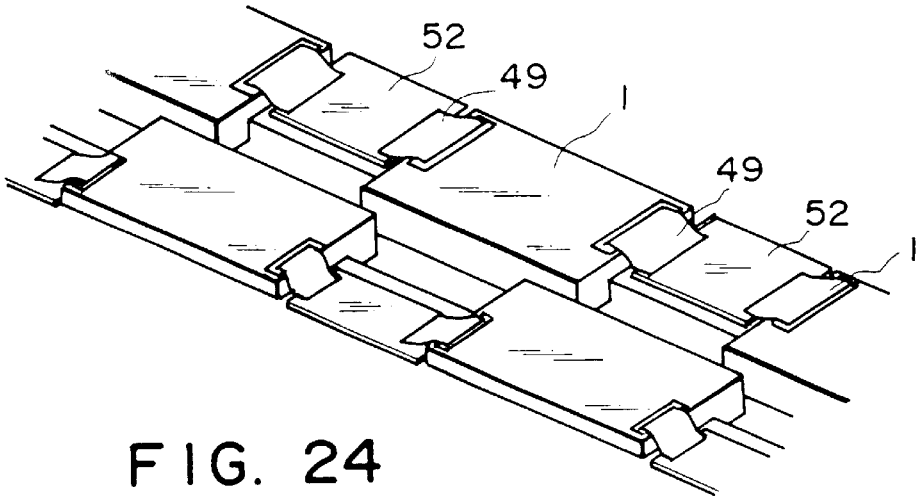
FIG. 24 is a perspective view of a recording apparatus according to an embodiment of the present invention, in which semiconductor chips are cascade- connected in staggered manner.

When the semiconductor chip recording elements are arranged in the staggered manner, a higher speed and a higher density printing becomes possible, as shown in FIG. 24. The relaying member or substrate is mounted on the substrate for supporting the semiconductor chip. This structure is advantageous in that when the recording element or the semiconductor chip is damaged for one reason or another, the semiconductor chip may be exchanged as a unit.

With this structure, the maintenance free use is possible. Since the recording elements corresponding to a recording width for one line and the function elements therefor and also the driving integration circuit, are structurally formed on the same substrate, so that the full-line recording apparatus capable of high reliability, high density and high speed, can be provided.

Figure 25:
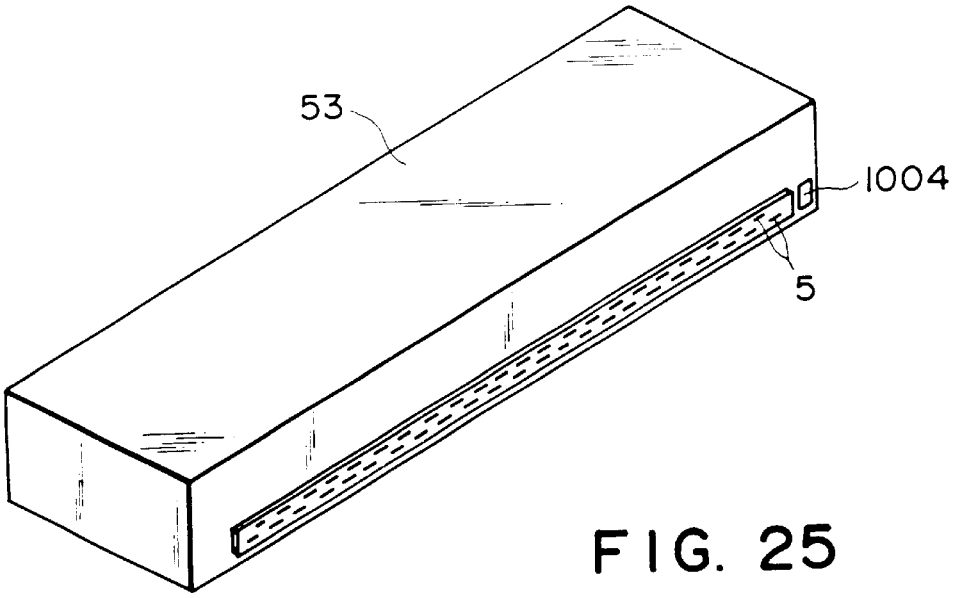
FIG. 25 is a perspective view of a recording head using the substrate of FIG. 24.
Figure 26A:
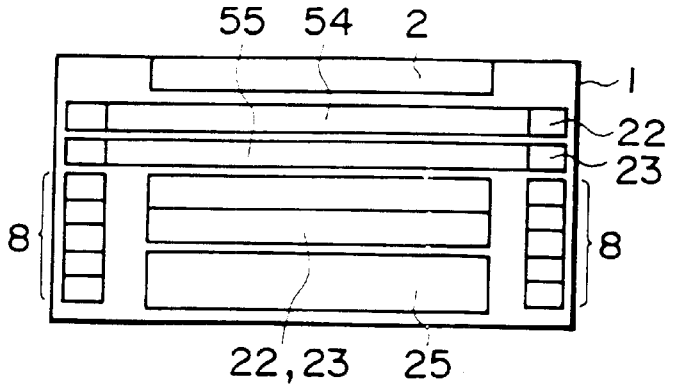
FIG. 26 is top plan views of substrates according to ether embodiments of the present invention.
Figure 26B:
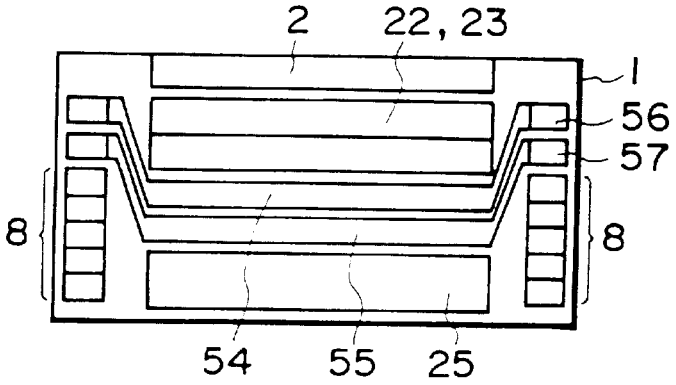
Figure 26C:
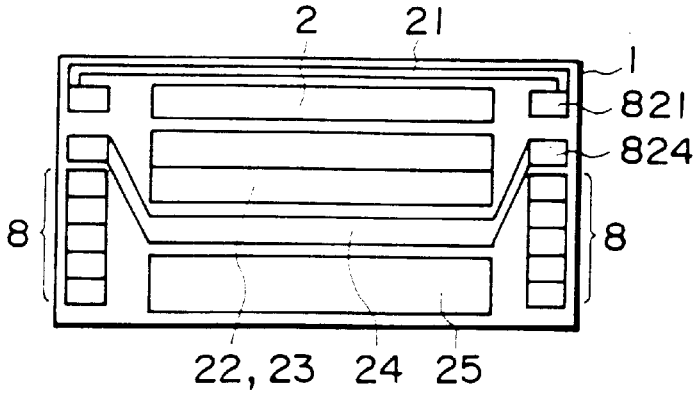
Figure 26D:
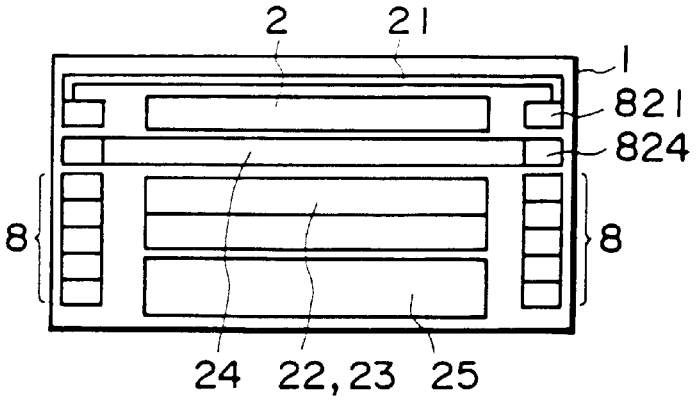

FIG. 25 shows a recording head unit provided by the connection of the substrates shown in FIG. 24.

Figure 23:
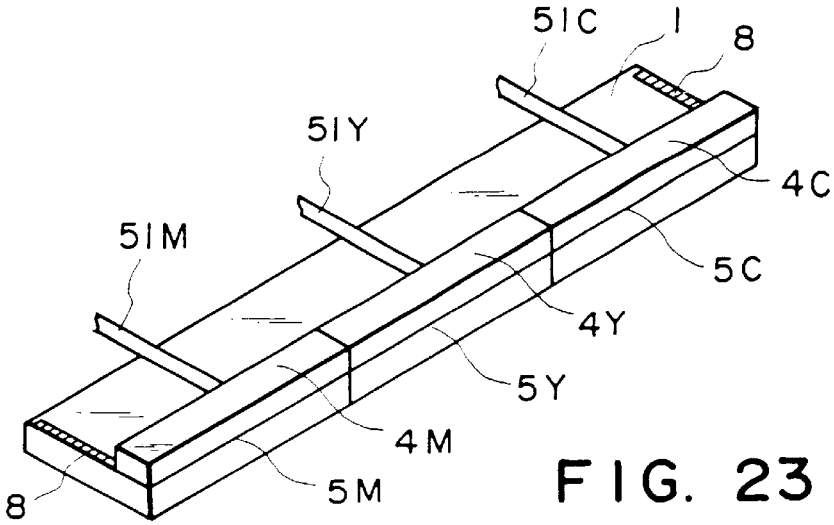
FIG. 23 is a perspective view of an elongated semiconductor chip of a recording apparatus according to an embodiment of the present invention.

FIG. 23 shows non-full-line type recording head, in which the recording elements corresponding to several tens semiconductor chips, the function elements and the drive integration circuits are formed on the same substrate, and the recording elements are grouped for the respective colors, and the respective liquid chambers 43M, 43Y and 43C are formed. By doing so, a color liquid ejection recording apparatus of high reliability, high density and high speed printing, can be provided. Designated by references 51M, 51Y and 51C are ink supply pipes for the magenta, yellow and cyan ink materials. As described hereinbefore, the liquid chamber may be separated for the respective colors in the case where the plural substrates are cascade- connected in a color recording head. Although not shown the liquid chamber is not divided and a monochromatic full-line liquid jet recording apparatus maybe provided.

Referring back to FIG. 18 showing an equivalent circuit capable of the cascade connection, it is different from the circuit of FIG. 3 in that the FIG. 18 circuit includes a delay circuit 48. The delay circuit of FIG. 18 will be described, referring also to the timing chart of FIG. 4.

Similarly to the foregoing embodiments, the clock signals 18 and the serial data signals 17 synchronized therewith, are supplied to the shift register circuit 11. When the plural heater boards 1 are cascade-connected. The number of clock signals 18 and the data 17 is the number of cascade connection m multiplied by the number n of the heater on the heater board. When all the data are set, the latching signal 16 is supplied to the latching circuit 12, so that the data is held.

With this state, a strobe signal 14 is supplied to the delay circuit 48. In the delay circuit 48, the delay time can be set for the respective heaters in relation to the input wave form of the strobe signal 14. It produces logical product of the delay wave form and the latching data signal. The ejection heater receives the logical product signal of the delay output and the enabling signal 15. Where the plural substrates 1 are cascade-connected, the enabling signal is effective to select the substrate 1 to be actuated by the signal, when only a selected substrate is to be actuated.

In this embodiment, any delay can be selected for the respective heaters by the addition of the delay circuit 48. This produces the following advantageous effects:

(1) Since the instantaneous current flow decreases due to the decrease of the number of simultaneously driven heaters, and therefore the voltage drops through the VH and GND lines can be minimized: and (2) It is possible to provide such a delay as to prevent the simultaneous actuation of adjacent heaters, in consideration of the problem that when the adjacent heaters are simultaneously driven in the ink jet recording head, the fluid cross-talk problem or the temperature rise might arise.

In this embodiment, the substrate 1 has a built in delay circuit for determining the drive timing, but the same advantageous effects can be provided by using plural strobe signal contacts.

Referring to FIG. 26, another embodiment of the circuit arrangement on the element substrate will be described. In FIG. 26, (a), the VH lines 54 and the GND lines are disposed immediately behind the electrothermal transducer element array 2, and they are connected with minimum distance therebetween, and therefore, the electric loss is minimum.

In the structure shown in FIG. 26 by (b), a top plate having passage constituting grooves is bonded to the substrate, as described hereinbefore, since the element substrate of this invention is mainly used for ink jet recording head. In order to enhance the contactness between the top plate and the substrate, it is preferable that the flatness of the surface of the substrate is high. In FIG. 26, (b), the intersection between first and second lines, occur at a position away from the recording elements where the high flatness is particularly desired. In the arrangement shown in FIG. 26 by (c), the VH line 21 is disposed closer to the substrate edge than the recording element array, and therefore, the circuit wiring is possible without necessity for the multi-layer structure of the wiring. Therefore, the cost is reduced. In addition, there is no fold-back wiring, so that the arrangements around the recording elements are more free, so that the width of the heater can be increased. In the arrangement shown in FIG. 26, by (d), the GND line 5 is disposed adjacent the recording element array 2 with the result of lower electric loss.

Figure 27:
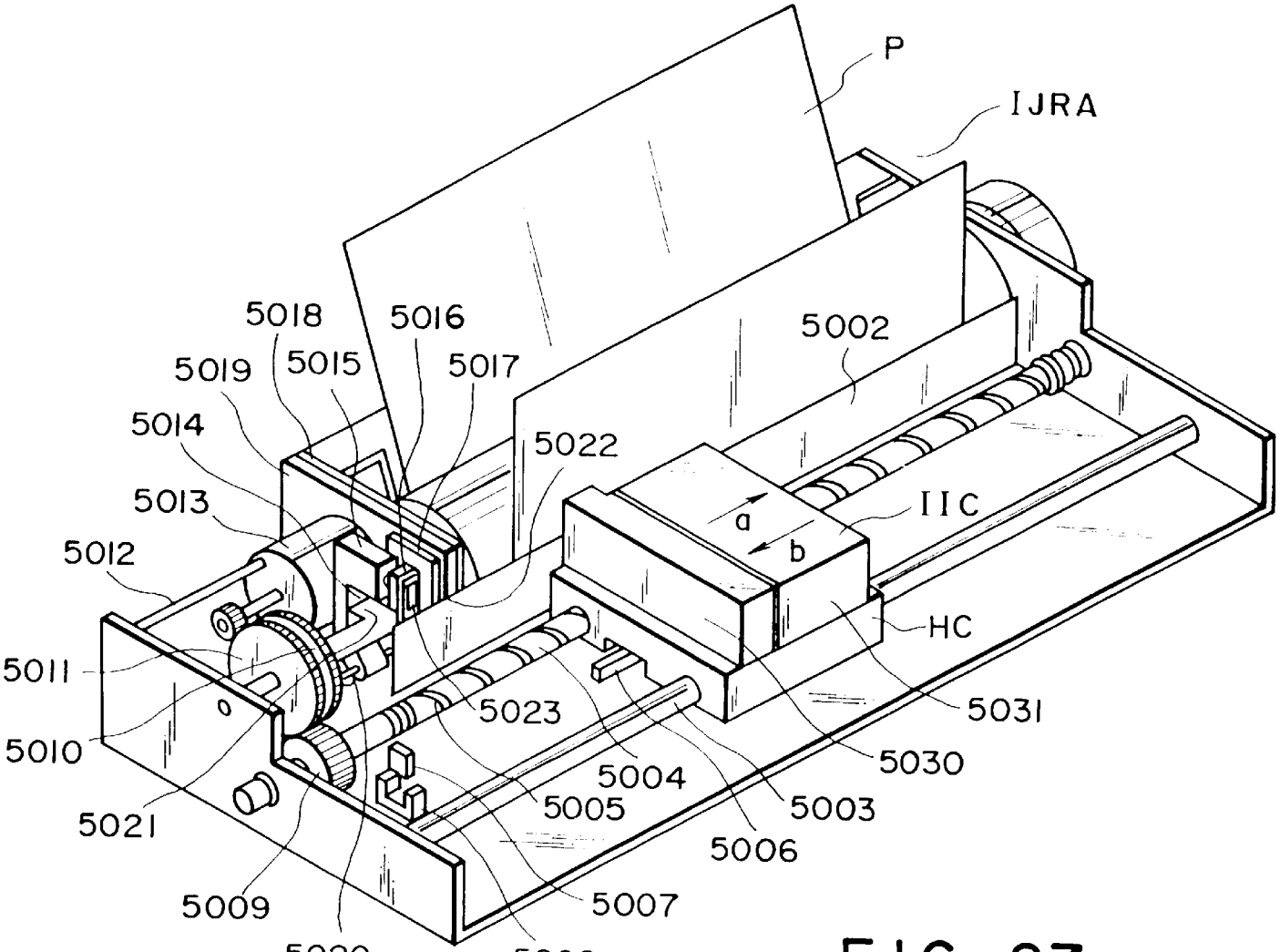
FIG. 27 is a perspective view of a recording apparatus to which the present invention is applicable.

FIG. 27 is a perspective view of a liquid jet recording apparatus IJRA to which the present invention is applicable. It comprises a lead screw 5005 which is rotatable by the forward and backward rotation of the driving motor 5013 through drive transmission gears 5011 and 5009. A carriage HC is engaged with the screw 5004 of the lead screw 5005. The carriage HC is provided with an unshown pin. The carriage is reciprocated in the directions a and b. A sheet confining plate 5002 urges the sheet to a platen 5000 over the carriage movable range. A photo-coupler constituted by elements 5007 and 5008 is effective to detect a lever 5006 of the carriage HC in the range to switch the rotational direction of the motor 5013. The position detected by the photocoupler is a home position. A supporting member 5016 supports a capping member 5022 for capping the front side of the recording head. A sucking means 5015 functions to suck the air in the cap to suck out the ink from the recording head through the ejection outlets and through an opening 5023 of the cap. A cleaning blade 5017 is movable toward and away from the recording head. These elements are supported on a supporting plate 5018. Other forms of cleaning members are applicable. A lever 5012 moves together with movement of a cam 5020 engaged with the carriage to start the sucking recovery operation. The driving force from the driving motor is transmitted by way of known transmitting means such as clutch or the like.

In this structure, the capping, cleaning and sucking operations are enabled when the carriage cams to the home position zone by the operation of the lead screw 5005. However, such operations may be carried out at different timing.

In this embodiment, the recording head cartridge is carried on the carriage HC. The recording head 5030 is separable from the ink container 5031. As will be understood from the foregoing description, the size of the recording head can be reduced according to the present invention, and therefore, the recording head can be easily mounted on the carriage or the like. Since the function of converting the recording signal from the serial signal to the parallel signal, which has been allotted to the main assembly of the printer, is now assigned to the substrate of the recording head, the recording apparatus may have a simple structure. Since the number of contacts for the signal supply in the recording head is small, the wiring is simplified, and the manufacturing steps are simplified. In addition, the compact and low cost recording apparatus can be provided.

In the recording head used with such an ink jet recording apparatus, the recording head may be exchangeable by the user or may not be exchangeable by the user. With the embodiments of the present invention, the number of electric contacts is small, and the area occupied by the contacts is small. For these reasons, the embodiments are particularly advantageous in the case of the recording heads capable of being exchanged by the users.

Figure 28:
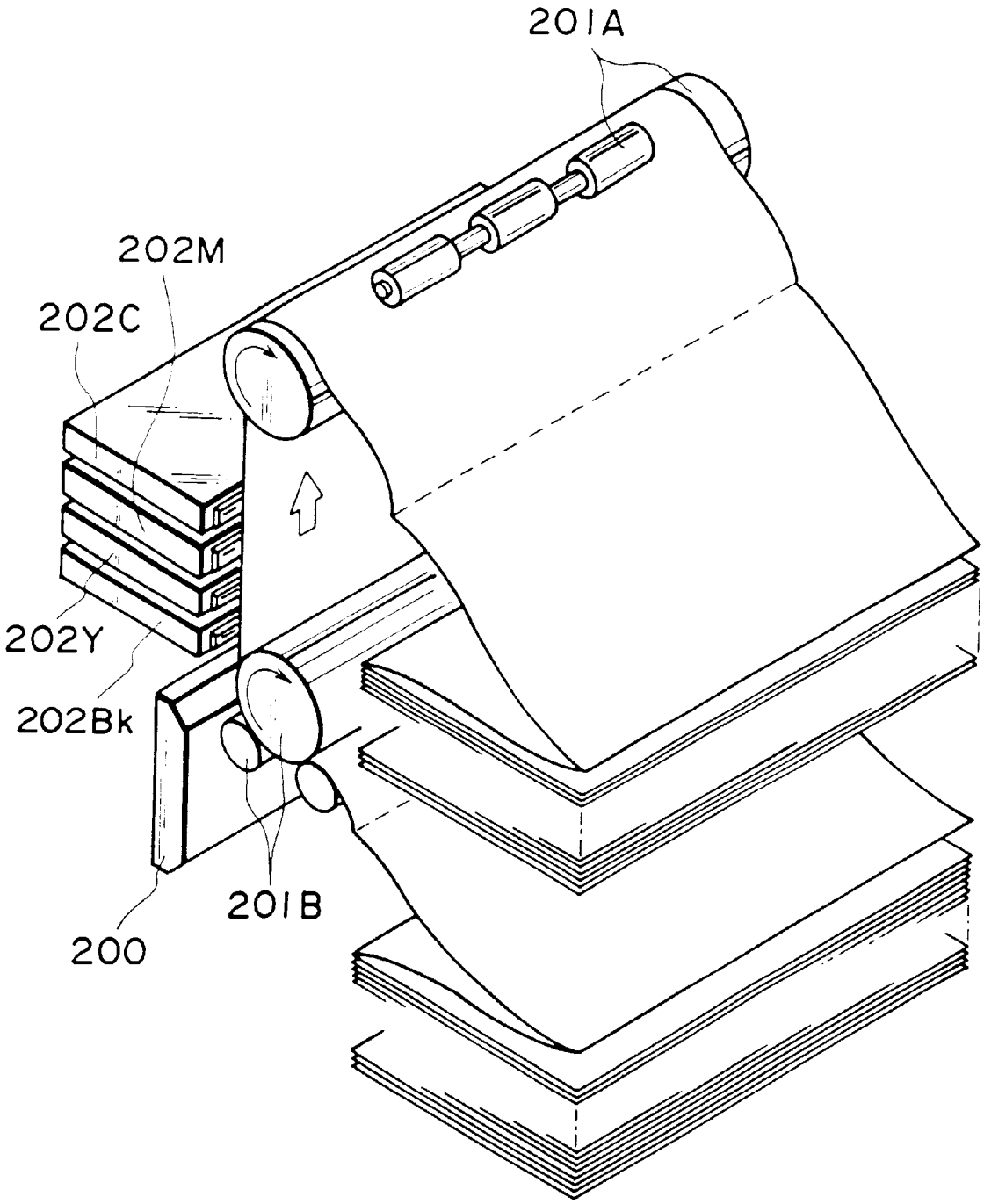
FIG. 28 is a perspective view of a recording apparatus to which the present invention is applicable.
Figure 29A:
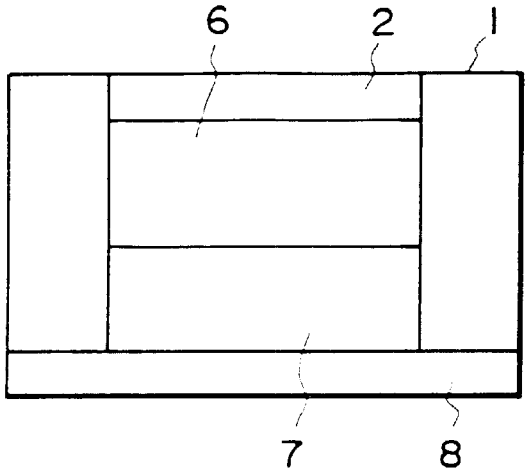
FIGS. 29 and 30 are top plan view of conventional substrates.
Figure 29D:
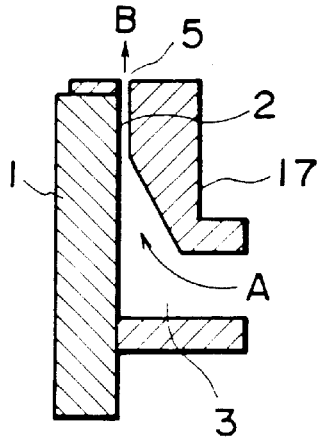
Figure 29B:
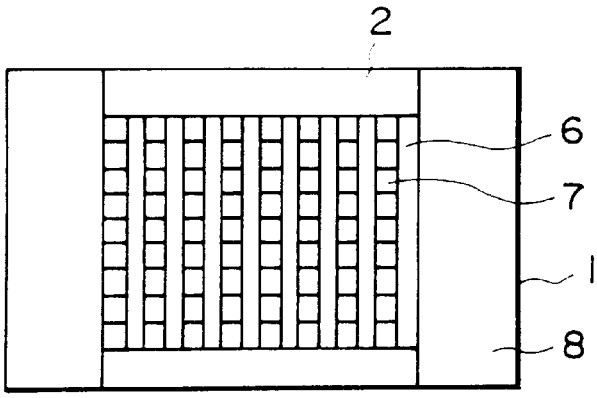
Figure 29C:
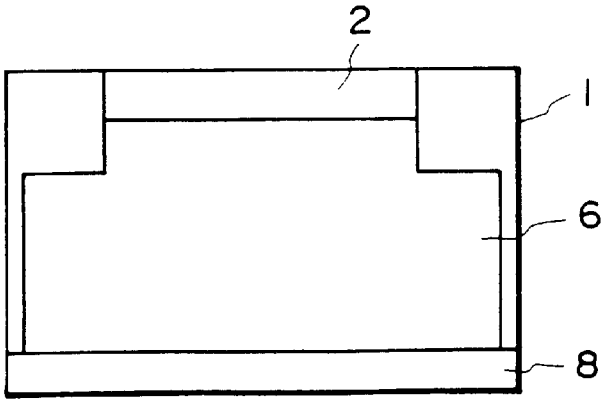
Figure 30A:
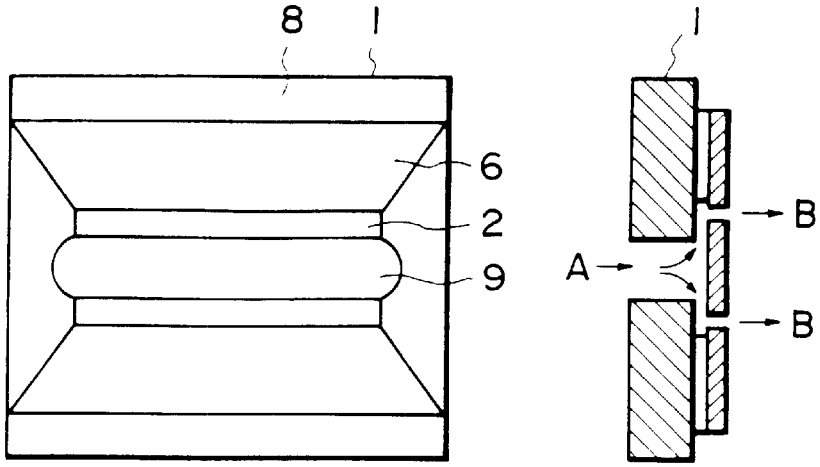
Figure 30B:
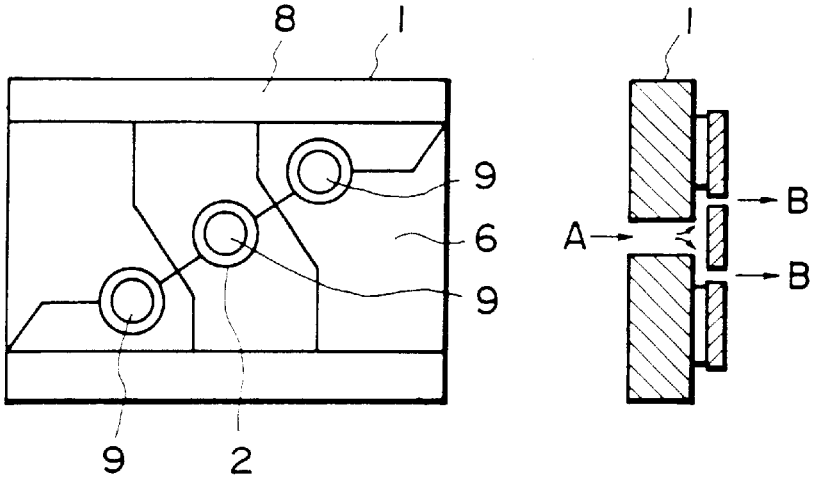
Figure 30C:
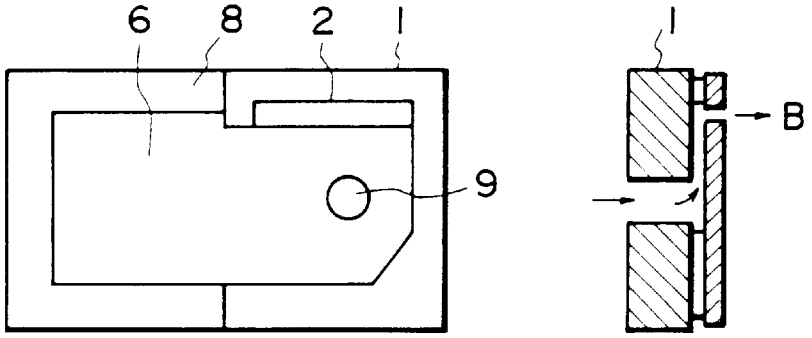
Figure 31:
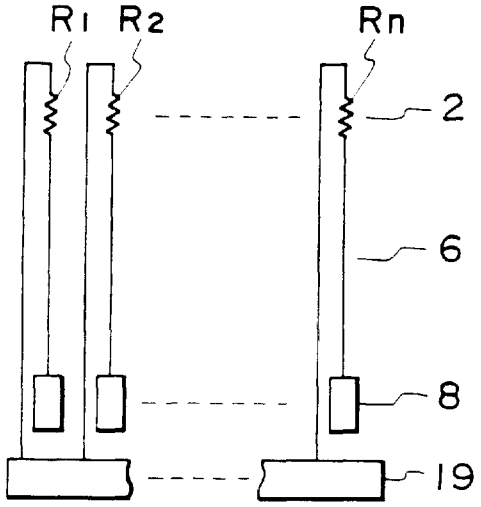
FIGS. 31 and 32 are circuit diagram of equivalent circuits thereof.
Figure 32:
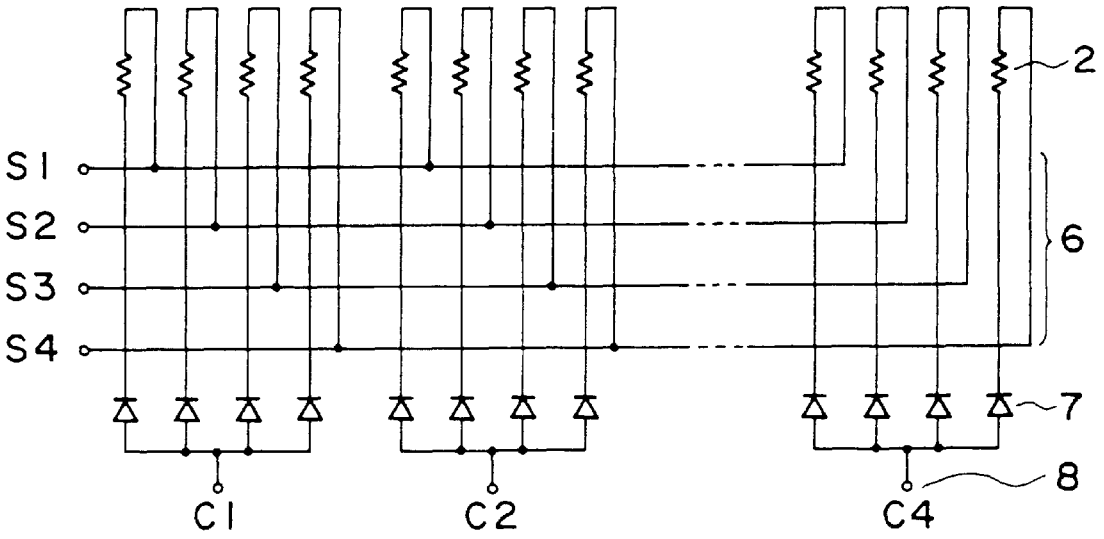
Figure 33:
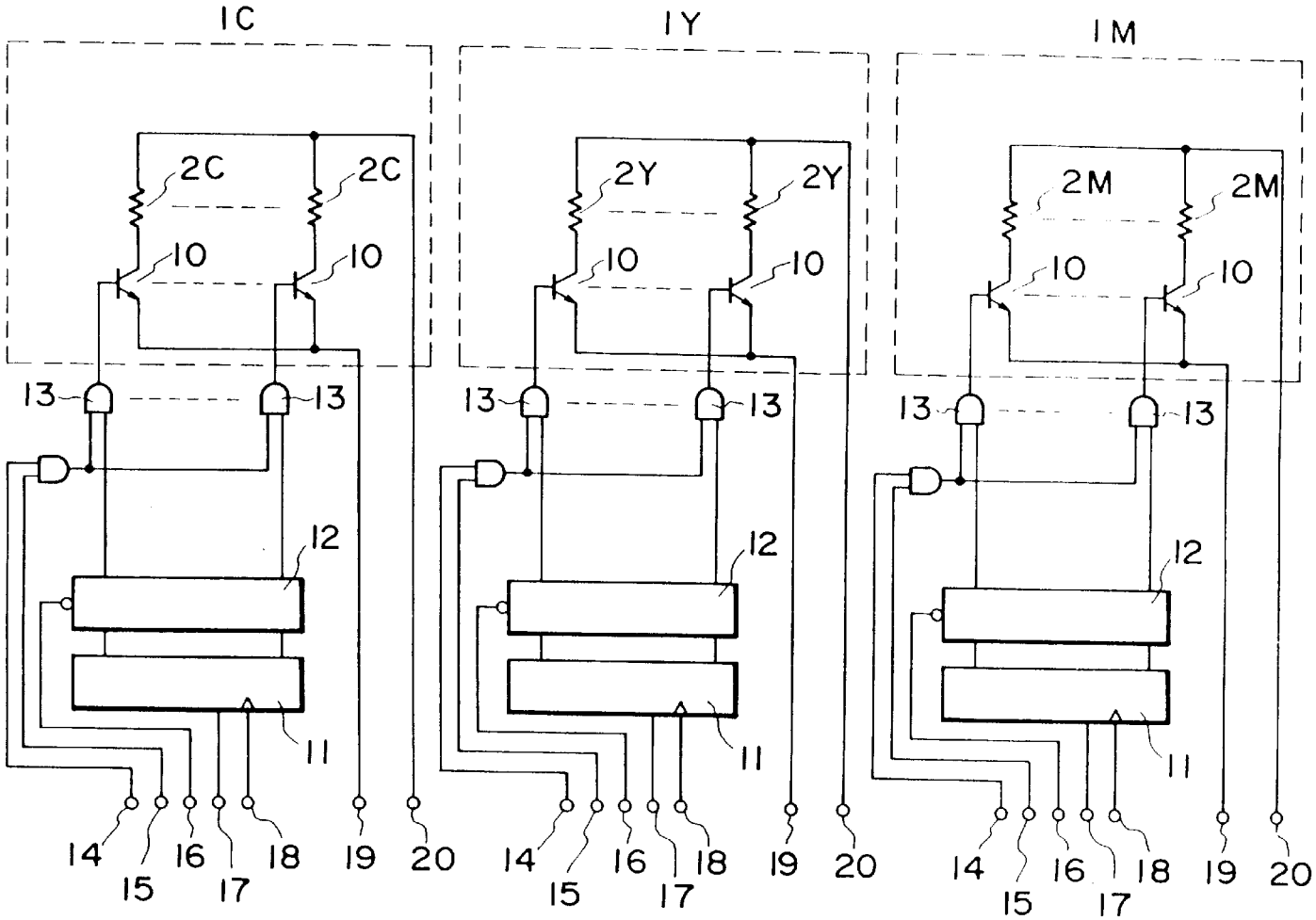
FIG. 33 is a circuit diagram of an equivalent circuit in a conventional color recording apparatus.

FIG. 28 shows a full-line type liquid jet recording apparatus. In this embodiment, the number of recording elements corresponding to several tens semiconductor chips, the function elements and the driving integrated circuits are formed on one substrate. Four of such line recording devices are used, corresponding to cyan, yellow, magenta and black color printings. It is possible to effect high quality full-color recording. A pair of rollers 201A and 201B are provided for feeding the recording material R in the sub-scan direction Vs. Full-line type recording means 202BK, 202Y, 202M and 202C have ink ejecting nozzles over a range corresponding to the entire width of the recording material R. They are arranged in the order of black, yellow, magenta and cyan from the upstream side of the recording material feed. An ejection recovery means 200 is faced to the recording means in place of the recording material R during the ejection recovery operation, and it includes a cap, ink absorbing material, a wiping blade or the like.

The typical structure and the operational principle are preferably the ones disclosed in U.S. Pat. Nos. 4,723,129 and 4,740,796. The principle and structure are applicable to a so-called on-demand type recording system and a continuous type recording system. Particularly, however, it is suitable for the on-demand type because the principle is such that at least one driving signal is applied to an electrothermal transducer disposed on a liquid (ink) retaining sheet or liquid passage, the driving signal being enough to provide such a quick temperature rise beyond a departure from nucleation boiling point, by which the thermal energy is provided by the electrothermal transducer to produce film boiling on the heating portion of the recording head, whereby a bubble can be formed in the liquid (ink) corresponding to each of the driving signals. By the production, development and contraction of the bubble, the liquid (ink) is ejected through an ejection outlet to produce at least one droplet. The driving signal is preferably in the form of a pulse, because the development and contraction of the bubble can be effected instantaneously, and therefore, the liquid (ink) is ejected with quick response. The driving signal in the form of the pulse is preferably such as disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion, as well as the structure of the combination of the ejection outlet, liquid passage and the electrothermal transducer as disclosed in the above-mentioned patents. In addition, the present invention is applicable to the structure disclosed in Japanese Laid-Open Patent Application No. 123670/1984 wherein a common slit is used as the ejection outlet for plural electrothermal transducer, and to the structure disclosed in Japanese Laid-Open Patent Application No. 138461/1984 wherein an opening for absorbing pressure wave of the thermal energy is formed corresponding to the ejecting portion. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head and plural recording head combined to cover the maximum width.

In addition, the present invention is applicable to a serial type recording head wherein the recording head is fined on the main assembly, to a replaceable chip type recording head which is connected electrically with the main apparatus and can be supplied with the ink when it is mounted in the main assembly, or to a cartridge type recording head having an integral ink container.

The provisions of the recovery means and/or the auxiliary means for the preliminary operation are preferable, because they can further stabilize the effects of the present invention. As for such means, there are capping means for the recording head, cleaning means therefor, pressing or sucking means, preliminary heating means which may be the electrothermal transducer, as additional heating element or a combination thereof. Also, means for effecting preliminary ejection (not for the recording operation) can stabilize the recording operation.

As regards the variation of the recording head mountable, it may be a single corresponding to a single color ink, or may be plural corresponding to the plurality of ink materials having different recording color or density. The present invention is effectively applicable to an apparatus having at least one of a monochromatic mode mainly with black, a multi-color mode with different color ink materials and/or a full-color mode using the mixture of the colors, which may be an integrally formed recording unit or a combination of plural recording heads.

Furthermore, in the foregoing embodiment, the ink has been liquid. It may be, however, an ink material which is solidified below the room temperature but liquefied at the room temperature. Since the ink is controlled within the temperature not lower than 30° C. and not higher than 70° C. to stabilize the viscosity of the ink to provide the stabilized ejection in usual recording apparatus of this type, the ink may be such that it is liquid within the temperature range when the recording signal is the present invention is applicable to other types of ink. In one of them, the temperature rise due to the thermal energy is positively prevented by consuming it for the state change of the ink from the solid state to the liquid state. Another ink material is solidified when it is left, to prevent the evaporation of the ink. In either of the cases, the application of the recording signal producing thermal energy, the ink is liquefied, and the liquefied ink may be ejected. Another ink material may start to be solidified at the time when it reaches the recording material. The present invention is also applicable to such an ink material as is liquefied by the application of the thermal energy. Such an ink material may be retained as a liquid or solid material in through holes or recesses formed in a porous sheet as disclosed in Japanese Laid-Open Patent Application No. 56847/1979 and Japanese Laid-Open Patent Application No. 71260/1985. The sheet is faced to the electrothermal transducers. The most effective one for the ink materials described above is the film boiling system.

The ink jet recording apparatus may be used as an output terminal of an information processing apparatus such as computer or the like, as a copying apparatus combined with an image reader or the like, or as a facsimile machine having information sending and receiving function.

As described in the foregoing, the ejection heaters, function elements and integrated circuits for selectively driving the function elements in response to the serial image data, and electric contacts for the external electric connection, are formed on one and the same substrate, and therefore, the electrical lead arrangement is not complicated even in a high density multi-nozzle structure. Because of the small number of contacts, the size of the head is reduced, and the reliability is increased. Also, it becomes easier to mount the substrate on the recording means or apparatus, and therefore, the cost is reduced.

In the recording head of the type which can be exchanged by the users, the advantages of the small size and the mounting or demounting reliabilities, are significant. According to the embodiments of the present invention, the fluid loss is reduced, and the utilization factor of the chip area is improved. In addition, the reliability of the electric contacts in the structure of using plural chips, is enhanced. Furthermore, the time series drive control for the purpose of avoiding fluid cross-talk peculiar to the ink jet printing, can be made easier.

According to the present invention, a great number of nozzles such as 18–several 1000 nozzles can be driven with the small number of electric contacts (8 at minimum), and there is no limit for the time shared drive. By the cascade connection of plural chips arranged in the longitudinal direction of the nozzle arrangement, the density of the recording elements can be enhanced significantly. Since the electric contacts do not obstruct the other arrangement, the chip may be disposed close to the electrothermal transducer element side or the opposite side therefrom. Since the electric contacts may be disposed at the opposite sides of the electrothermal transducer elements, and the wiring resistance can be minimized.

Since the shift register and or the driver transistor or the like which have been disposed conventionally away from the substrate, may be built in the substrate, by which the resistance of the leads can be minimized. Thus, the energy loss can be reduced. Particularly in the case of the ink jet system, the driving current is as large as several hundred mA due to the principle of the bubble ejection requiring bubble creation, the present invention is advantageous. When the apparatus is driven by buttery, the advantageous effects of the present invention are also significant.

While the invention has been described with reference to the structures disclosed herein, it is not confined to the details set forth and this application is intended to cover such modifications or changes as may come within the purposes of the improvements or the scope of the following claims.

What is claimed is:

1. An ink jet recording head comprising:

a plurality of groups of recording elements each of which is capable of generating heat to eject ink, the groups of the recording elements corresponding to respective kinds of the ink and being disposed with a space from an adjacent group;

a semiconductor substrate having a built-in integrated circuit for driving the recording elements;

a plurality of groups of ejection outlets, disposed on said semiconductor substrate, the groups of the ejection outlets being spaced from an adjacent group, corresponding to the kinds of the ink and to the groups of the recording elements;

wherein the integrated circuit on said substrate receives image data for the groups of the recording elements corresponding to respective kinds of ink, in which image data are serially arranged, and outputs the data as parallel signals to the respective groups of the recording elements.

2. Ink jet recording head according to claim 1, further comprising an ink supply member, for supplying the ink, disposed corresponding to each of the groups of recording elements.

3. A semiconductor substrate for a recording head, comprising:

a plurality of recording elements for reflecting recording;

function elements arranged for selectively driving heat generating resistor elements electrically connected with respective ones of said recording elements;

an integrated circuit connected to receive serial image data and to output such data to said function elements as parallel signals;

wherein said recording elements, function elements and integrated circuit are built into said substrate;

a signal input portion arranged to receive serial image data from outside said substrate and to output such data to said integrated circuit; and a signal output portion connected to output the serial image data from said integrated circuit to a location outside said substrate.

4. A semiconductor substrate according to claim 3, wherein said recording elements are electrothermal transducers.

5. A semiconductor substrate according to claim 3, further comprising an electrical contact associated with said signal input portion and an electrical contact associated with said signal output portion, wherein said electrical contacts are disposed on the same side of said substrate.

6. An ink jet recording head comprising:

an array of semiconductor substrates for a recording head, which includes;

a plurality of recording elements for reflecting recording;

function elements arranged for selectively driving heat generating resistor elements electrically connected with respective ones of said recording elements;

an integrated circuit connected to receive serial image data and to output such data to said function elements as parallel signals;

wherein said recording elements, function elements and integrated circuit are built into said substrate;

wherein said integrated circuit is constructed and arranged to output serial image data received thereby to said function elements as parallel signals and to output serially the image data to an adjacent ones of said semiconductor substrates;

a signal input portion arranged to receive serial image data from outside said semiconductor substrate and to output such data to said integrated circuit; and a signal output portion connected to output the serial image data from said integrated circuit to a location outside said integrated circuit.

7. An ink jet recording head according to claim 6, wherein said semiconductor substrates are provided corresponding to respective kinds of inks to be ejected.

8. An ink jet recording head according to claim 7, further comprising ink passages corresponding to each of said recording elements on each of said semiconductor substrates, said ink passages each being in fluid communication with a corresponding ejection outlet, wherein inks corresponding to the respective semiconductor substrates pass through said ink passages and through ejection outlets, respectively.

9. An ink jet recording apparatus comprising a recording head as defined in any one of claims 1, 2, 7 or 8, and further comprising means for supplying to said recording head serial image data, including serially arranged image data, corresponding to a plurality of kinds of inks.

10. An ink jet recording apparatus according to claim 9, further comprising means for effecting block-division driving for respective kinds of inks.

11. An ink jet recording apparatus comprising a recording head as defined in any one of claims 1, 2, 7 or 8, and further including means for feeding a recording material for receiving the ink ejected from said recording head.

12. An ink jet recording head according to any one of claims 1, 2 or 6–8, wherein said recording elements are electrothermal transducers for ejecting said inks.

13. An ink jet recording head according to any one of claims 1, 2 or 6–8, further comprising an ink container for supplying the ink to said recording head.

14. An ink jet recording head according to claim 6, further comprising a delay circuit, disposed between said integrated circuit on said semiconductor substrate and said function elements, for adjusting drive timing for the respective recording elements.

15. An ink jet recording head according to claim 6, wherein the number of said heat generating resistor elements is not less than 16.

16. An ink jet recording head according to claim 6, wherein said signal output portion of a said semiconductor substrate is directly and the electrically connected with said signal input portion of an adjacent one of said semiconductor substrates.

17. A substrate, comprising:

a plurality of recording elements in the form of liquid ejection energy generating means which are integrally built into said substrate;

a plurality of electrical leads, electrically connected to said recording elements, and connected in a circuit for supplying electric signals to said recording elements;

an electrical contact for external electrical connection for reception of image signals which are supplied serially and which are used for driving said recording elements:

a plurality of selector elements integrally built into said substrate and electrically connected to said recording elements for selectively controlling the application of driving current to said recording elements;

a logic circuit, integrally built into said substrate, and having a circuit, connected to said electrical contact, for receiving said image signals and for converting said image signals which are serially supplied to said electrical contact into parallel signals and having a circuit, electrically connected to said selector elements, for holding the parallel signals and connected to supply them to the selector elements;

a first common lead electrically connected to said liquid ejection energy generating means to supply a driving voltage to said recording elements; and a second common lead electrically connected to said selector elements to electrically ground said selector elements;

said liquid ejection energy generating means being disposed at an edge portion of said substrate closer to a position to which the ink is supplied.

18. A substrate according to claim 17, wherein said second common lead is disposed between said liquid ejection energy generating means and said logic circuit.

19. A substrate, comprising:

a plurality of recording elements in the form of liquid ejection energy generating means which are integrally built into said substrate;

a plurality of electrical leads, electrically connected to said recording elements, and connected in a circuit for supplying electric signals to said recording elements;

an electrical contact for external electrical connection for reception of image signals which are supplied serially and which are used for driving said recording elements;

a plurality of selector elements integrally built into said substrate and electrically connected to said recording elements for selectively controlling the application of driving current to said recording elements;

a logic circuit, integrally built into said substrate, and having a circuit, connected to said electrical contact, for receiving said image signals and for converting said image signals which are serially supplied to said electrical contact into parallel signals and having a circuit, electrically connected to said selector elements, for holding the parallel signals and connected to supply them to the selector elements;

a first common lead electrically connected to said liquid ejection energy generating means to supply a driving voltage to said recording elements; and a second common lead electrically connected to said selector elements to electrically ground said selector elements;

said liquid ejection energy generating means being disposed at a position closer to one end portion of said substrate than said first common lead.

20. A substrate according to claim 17 or 19, wherein said recording elements are electrothermal transducers.

21. A substrate according to claim 17 or 19, wherein said logic circuit comprises a shift register circuit; and a latching circuit.

22. A substrate according to claim 17 or 19, wherein said plurality of selector elements are disposed between said logic circuit and said energy generating means.

23. A substrate according to claim 17 or 19, wherein said plurality of selector elements are arranged in a plurality of arrays.

24. A liquid jet head comprising a plurality of liquid passages communicating with a liquid ejecting portion for ejecting a liquid; and a substrate as defined in claim 17 or 19.

25. A liquid jet head according to claim 24, wherein said recording elements are electrothermal transducers.

26. A liquid jet head according to claim 24, wherein said logic circuit comprises a shift register circuit; and a latching circuit.

27. A liquid jet head according to claim 24, wherein said selector elements are disposed between said logic circuit and said energy generating means.

28. A liquid jet head according to claim 24, wherein said selector elements are arranged in a plurality of arrays.

29. A liquid jet head according to claim 24, wherein the liquid is ink for recording.

30. A liquid jet apparatus comprising:

a recording head as defined in claim 24; and further including means for carrying said recording head.

31. A liquid jet apparatus according to claim 30, wherein said recording elements are electrothermal transducers.

32. A liquid jet apparatus according to claim 30, wherein said logic circuit comprises a shift register circuit; and a latching circuit.

33. A liquid jet apparatus according to claim 30, wherein said selector elements are disposed between said logic circuit and said energy generating means.

34. A liquid jet apparatus according to claim 30, wherein said selector elements are arranged in a plurality of arrays.

35. A liquid jet apparatus according to claim 30, wherein the liquid is ink for recording.

36. A substrate according to claim 19, wherein said second common lead is disposed between said liquid ejection energy generating means and said logic circuit.

* * * * *

UNITED STATES PATENT AND TRADEMARK OFFICE

CERTIFICATE OF CORRECTION

PATENT NO. : 6,474,789 B1
DATED : November 5, 2002
INVENTOR(S) : Hiroyuki Ishinaga et al.

It is certified that error appears in the above-identified patent and that said Letters Patent is hereby corrected as shown below:

Title page,
Item [56], FOREIGN PATENT DOCUMENTS, “1232072” should read -- 1-232072 --.

Column 5,
Line 27, “s” should read -- a --; and
Line 51, “is” should read -- are -- and “ether” should read -- other --.

Column 6,
Line 44, “18” (second occurrence) should read -- 17 --.

Column 8,
Line 6, “transistor” should read -- transistors --.

Column 10,
Line 26, “element” should read -- elements --; and
Line 32, “is” should read -- are --.

Column 18,
Line 30, “ones” should read -- one --.

Column 19,
Line 23, “elements:” should read -- elements; --.

Signed and Sealed this

Ninth Day of September, 2003

JAMES E. ROGAN
*Director of the United States Patent and Trademark Office*